US012365995B2

(12) United States Patent
Xie et al.

(10) Patent No.: US 12,365,995 B2
(45) Date of Patent: Jul. 22, 2025

(54) $CO_2$RR-OOR ELECTROLYSER SYSTEM AND RELATED PROCESS FOR FACILITATING THE CAPTURE AND CONVERSION OF $CO_2$ IN GAS MIXTURE STREAMS

(71) Applicants: TOTALENERGIES ONETECH, Courbevoie (FR); THE GOVERNING COUNCIL OF THE UNIVERSITY OF TORONTO, Toronto (CA)

(72) Inventors: Ke Xie, Toronto (CA); Adnan Ozden, Toronto (CA); Edward H. Sargent, Toronto (CA); David Sinton, Toronto (CA); Amitava Sarkar, Houston, TX (US); Shaffiq Jaffer, Houston, TX (US)

(73) Assignees: TOTALENERGIES ONETECH, Courbevoie (FR); THE GOVERNING COUNCIL OF THE UNIVERSITY OF TORONTO, Toronto (CA)

( * ) Notice: Subject to any disclaimer, the term of this patent is extended or adjusted under 35 U.S.C. 154(b) by 0 days.

(21) Appl. No.: 18/864,297

(22) PCT Filed: May 10, 2023

(86) PCT No.: PCT/EP2023/062389
§ 371 (c)(1),
(2) Date: Nov. 8, 2024

(87) PCT Pub. No.: WO2023/217842
PCT Pub. Date: Nov. 16, 2023

(65) Prior Publication Data

US 2025/0109512 A1 Apr. 3, 2025

Related U.S. Application Data

(60) Provisional application No. 63/340,448, filed on May 10, 2022.

(30) Foreign Application Priority Data

May 24, 2022 (LU) ..... LU502158

(51) Int. Cl.
*C25B 3/26* (2021.01)
*C25B 3/03* (2021.01)
(Continued)

(52) U.S. Cl.
CPC ..... *C25B 3/26* (2021.01); *C25B 3/03* (2021.01); *C25B 9/23* (2021.01); *C25B 9/70* (2021.01);
(Continued)

(58) Field of Classification Search
None
See application file for complete search history.

(56) References Cited

U.S. PATENT DOCUMENTS

2019/0055656 A1 2/2019 Kenis et al.
2021/0079538 A1* 3/2021 Schmid ..... C25B 9/19
2021/0292925 A1 9/2021 Mikoshiba et al.

FOREIGN PATENT DOCUMENTS

DE 102020207192 A1 12/2021
WO 2014046794 A2 3/2014

OTHER PUBLICATIONS

International Search Report and Written Opinion issued in Application No. PCT/EP2023/062389, dated Sep. 19, 2023, 12 pages.
(Continued)

*Primary Examiner* — Wojciech Haske
(74) *Attorney, Agent, or Firm* — Ewing & Jones, PLLC

(57) ABSTRACT

The present disclosure relates to a MEA electrolyser comprising a cathodic compartment operating CO2 reduction reactions ($CO_2$RR) of $CO_2$ from a gaseous $CO_2$-containing stream, an anodic compartment operating all-liquid organic
(Continued)

oxidation reactions (OOR), an ionic exchange membrane in between. A $CO_2$RR-OOR system can further include a gas-liquid separation unit in fluid communication with the anodic compartment to receive the anodic product mixture and separate gaseous $CO_2$ from the anodic product mixture to produce a $CO_2$-depleted liquid product stream and a recovered pure gaseous $CO_2$ stream. The system can further include a recycle line in fluid communication with the gas-liquid separation unit to redirect the recovered pure gaseous $CO_2$ stream to the cathodic compartment of the MEA electrolyser as a portion of the gaseous $CO_2$-containing stream. The present disclosure also concerns a process for electrochemically converting the gaseous $CO_2$-containing stream to multi-carbon products in such a MEA $CO_2$RR-OOR electrolyser.

12 Claims, 21 Drawing Sheets

(51) Int. Cl.
*C25B 9/23* (2021.01)
*C25B 9/70* (2021.01)
*C25B 11/091* (2021.01)
*C25B 13/08* (2006.01)
*C25B 15/08* (2006.01)

(52) U.S. Cl.
CPC ..... *C25B 11/091* (2021.01); *C25B 13/08* (2013.01); *C25B 15/087* (2021.01)

(56) References Cited

OTHER PUBLICATIONS

International Preliminary Report on Patentability issued in Application No. PCT/EP2023/062389, dated Apr. 3, 2024, 16 pages.
Novalin Timon et al., "Electrochemical performance of poly(arylene piperidinium) membranes and ionomers in anion exchange membrane fuel cells", Journal of Power Sources, Elsevier, Amsterdam, NL, vol. 507, Jul. 22, 2021, 13 pages.

* cited by examiner

$CO_2$RR-OOR ELECTROLYSER SYSTEM AND RELATED PROCESS FOR FACILITATING THE CAPTURE AND CONVERSION OF $CO_2$ IN GAS MIXTURE STREAMS

CROSS-REFERENCE TO RELATED APPLICATIONS

This application claims the benefit of PCT/EP2023/062389 filed May 10, 2023, which claims priority from U.S. 63/340,448 filed May 10, 2022, and LU502158 filed May 24, 2022 which are incorporated herein by reference in their entireties for all purposes.

TECHNICAL FIELD

The present technology generally relates to $CO_2$ electroreduction into multi-carbon products, and more particularly to a system and related process involving controlled $CO_2$ reduction reactions ($CO_2$RR) and organic oxidation reactions (OOR) to facilitate the capture of crossover $CO_2$.

BACKGROUND

The electrochemical conversion of $CO_2$ ($CO_2$RR) to multi-carbon ($C_{2+}$) chemicals is a promising approach to storing renewable energy and closing the carbon cycle, see the study of Verma S., et al., entitled "Co-electrolysis of $CO_2$ and glycerol as a pathway to carbon chemicals with improved technoeconomics due to low electricity consumption" (Nat. Energy, 2019, 4, 466-474). State-of-art $CO_2$RR flow cell systems-see the study of Garcia de Arquer, F. P., et al., entitled "*$CO_2$ electrolysis to multicarbon products at activities greater than 1 A cm$^{-2}$*" (*Science,* 2020, 367, 661-666)—, and zero-gap membrane electrode assembly (MEA) systems-see studies of Gabardo C. M., et al., entitled "*Continuous Carbon Dioxide Electroreduction to Concentrated Multi-carbon Products Using a Membrane Electrode Assembly*" (Joule, 2019, 3, 2777-2791), of Li F., et al., entitled "*Molecular tuning of $CO_2$-to-ethylene conversion*" (Nature, 2020, 577, 509-513) and of Ozden A., et al., entitled "*High-rate and efficient ethylene electrosynthesis using a catalyst/promoter/transport layer*" (*ACS Energy Lett.,* 2020, 5, 2811-2818)-achieve $C_{2+}$ Faradaic efficiencies (FEs) exceeding 70% and $C_{2+}$ partial current densities of 1 A cm$^{-2}$ (flow cells) and 100 mA cm$^{-2}$ (MEAs). These productivity levels are in the regime of interest on the path toward industrial application.

Industrial $CO_2$ streams with 98%+ purity are being used for the electro-conversion of $CO_2$, generated through selective capture of $CO_2$ from anthropogenic or nature point sources. Significantly high cost and low energy efficiency associated with industrial $CO_2$ capture negatively affect the techno-economic feasibility of $CO_2$ electrolysis when a pure stream of $CO_2$ is used as feed to the electrolyser. Additionally, the energy required for present-day $CO_2$-to-$C_{2+}$ electrolysis is too high—for example, when targeting ethylene, known electrosynthesis systems require 8× more energy to produce ethylene than is embodied in the product. Major energy costs are incurred in the electrolyser and the downstream separation steps. Established approaches to reducing the electrolysis energy requirements include increasing the selectivity for the target product and incorporating alternative anode reactions.

The major energy penalty associated with the downstream separation of $CO_2$ remains a challenge. Downstream separation is required to isolate products and recover unconverted $CO_2$ from the product streams and electrolytes. Recovering $CO_2$ is particularly costly, requiring 25% and 70% of total energy input for neutral and alkaline media $CO_2$-to-$C_{2+}$ electrolysers, respectively.

Current $CO_2$RR catalysts operate with highly alkaline local conditions (pH>12) to promote $C_{2+}$ generation at the cathode, see the study of Garcia de Arquer, F. P., et al., entitled "*$CO_2$ electrolysis to multicarbon products at activities greater than 1 A cm$^{-2}$*" (*Science,* 2020, 367, 661-666). However, the carbonate-forming side reaction ($CO_2$+ $OH^- \rightarrow CO_3^{2-}$ or $HCO_3^-$) is favoured under alkaline conditions, consuming the majority of the $CO_2$ injected by forming (bi)carbonates. Operating with neutral electrolytes (e.g., $KHCO_3$) in a membrane electrode assembly cell can mitigate $CO_2$ loss to (bi) carbonates. However, ~ 70% of input $CO_2$ crosses the anion exchange membrane (AEM) to the anode as (bi) carbonate ions, which combine with the protons generated from the anodic reaction to regenerate $CO_2$ back (see FIG. 1). Combining crossover $CO_2$ with $O_2$ produced via the oxygen evolution reaction (OER) results in an anode gas mixture of 60-80% $CO_2$ and 20-40% $O_2$ (see the study of Ma M., et al., entitled "*Insights into the carbon balance for $CO_2$ electroreduction on Cu using gas diffusion electrode reactor designs*" (*Energy Environ. Sci.,* 2020, 13, 977-985)). This gas mixture cannot be directly used as input for further electrochemical $CO_2$ reduction because oxygen reduction would dominate at the cathode. As a result, separation of crossover $CO_2$ is required downstream of the anode, incurring an energy penalty of 57-70 GJ per ton of ethylene produced (FIG. 2, Table 1)—an energy cost greater than the lower heating value of ethylene (47 GJ ton$^{-1}$): indeed, recent energy and technoeconomic assessments demonstrated that the separation penalty associated with anodic $CO_2$ recovery is prohibitive.

DE 10 2020 207 192 concerns a carbon dioxide reduction reaction/organic oxidation reaction ($CO_2$RR/OOR) system, in which $CO_2$ is reduced in a cathode compartment into CO, while acetic acid is oxidized into peroxyacetic acid in an anodic compartment. The cathode and the anode in the electrolytic system are separated by an anion exchange membrane (AEM). A catholyte is circulated through the cathode chamber and has a pH of about 10.5 to 11.5.

WO2014/046794 concerns a method wherein $CO_2$ forms a $CO_2$RR product at the cathode of an electrolytic system and wherein, simultaneously, an organic compound is oxidized into $CO_2$ at the anode, the $CO_2$ formed at the anode being included in the $CO_2$ feed required at the cathode along with a catholyte.

There is thus a need for a technology that overcomes at least some of the drawbacks of what is known in the field, such as the above-mentioned drawbacks that may result. In particular, there is a need to provide a process and system to convert $CO_2$ into multi-carbon products while optimizing the use of $CO_2$ from the $CO_2$ feedstream, such as minimizing $CO_2$ loss.

SUMMARY

In its first aspect, the present disclosure relates to a process for electrochemically converting a gaseous carbon dioxide stream to multi-carbon products having at least two carbon atoms in a carbon dioxide reduction reaction/organic oxidation reaction ($CO_2$RR/OOR), the process is remarkable in that it comprises:

a) providing a $CO_2$RR/OOR system being a catholyte-free system and comprising:

an anodic compartment comprising an anode and configured to operate the organic oxidation reaction; and a cathodic compartment comprising a cathode with a $CO_2$ reduction reaction catalyst being or comprising copper and being configured to operate carbon dioxide reduction reactions;

b) providing a solution comprising an anolyte and an organic liquid-phase precursor of an organic oxidation reaction;

c) supplying the solution to the anodic compartment of the $CO_2$RR/OOR system to operate the organic oxidation reaction and generate an anodic product mixture comprising OOR liquid-phase products;

d) supplying a gaseous $CO_2$-containing stream to the cathodic compartment of the $CO_2$RR/OOR system to operate the reduction of a first portion of $CO_2$ and generate a cathodic product mixture comprising multi-carbon products, wherein a second portion of $CO_2$ is transferred to the anodic compartment by an ionic exchange to produce a crossover $CO_2$;

e) recovering the anodic product mixture from the anodic compartment, the anodic product mixture comprising the crossover $CO_2$;

f) separating the crossover $CO_2$ from the anodic product mixture to produce a $CO_2$-depleted product stream and a recovered pure gaseous $CO_2$ stream. Particularly, the present techniques include a process for electrochemically converting a gaseous carbon dioxide ($CO_2$) stream to multi-carbon products ($C_{2+}$) at the cathode while producing a pure stream of $CO_2$ at the anode in a catholyte-free electrolyser, preferably in a membrane electrode assembly (MEA) electrolyser, or in an anolyte-containing one-gap electrolyser. The recovered pure stream of $CO_2$ can be recycled to the same system or directed to another system in series to produce CO or other products.

According to a second aspect, the present disclosure relates to a carbon dioxide reduction reaction/organic oxidation reaction ($CO_2$RR/OOR) system to perform the process according to the first aspect, the system is remarkable in that it comprises:

a cathodic compartment comprising:

a cathodic inlet configured to receive a gaseous $CO_2$-containing stream;

a cathode comprising a $CO_2$ reduction reaction catalyst being or comprising copper suitable to sustain the reduction of $CO_2$ into the multi-carbon products;

a cathodic outlet configured to release a cathodic product mixture comprising the multi-carbon products from the cathodic compartment;

an anodic compartment comprising:

an anodic inlet configured to receive a solution comprising an anolyte and an organic liquid-phase precursor;

an anode comprising an organic oxidation reaction catalyst sustaining oxidation of the organic liquid precursor into OOR liquid-phase products;

an anodic outlet configured to release an anodic product mixture comprising $CO_2$ and the OOR liquid-phase products from the anodic compartment;

an ionic exchange membrane positioned between the cathodic compartment and the anodic compartment to enable ion exchange therebetween; and a gas-liquid separation unit in fluid communication with the anodic compartment configured to receive the anodic product mixture and to separate the anodic product stream into a $CO_2$-depleted liquid stream and a pure gaseous $CO_2$ stream.

With preference, the present disclosure relates to a carbon dioxide reduction reaction/organic oxidation reaction ($CO_2$RR/OOR) system to perform the process according to the first aspect, the system is remarkable in that it comprises:

a cathodic compartment comprising:

a cathodic inlet configured to receive a gaseous $CO_2$-containing stream;

a cathode comprising a $CO_2$ reduction reaction catalyst being or comprising copper suitable to sustain the reduction of $CO_2$ into the multi-carbon products;

a cathodic outlet configured to release a cathodic product mixture comprising the multi-carbon products from the cathodic compartment;

an anodic compartment comprising:

an anodic inlet configured to receive a solution comprising an anolyte and an organic liquid-phase precursor;

an anode comprising an organic oxidation reaction catalyst sustaining oxidation of the organic liquid precursor into OOR liquid-phase products;

an anodic outlet configured to release an anodic product mixture comprising $CO_2$ having been transferred to the anodic compartment by ion exchange and the OOR liquid-phase products from the anodic compartment;

an ionic exchange membrane positioned between the cathodic compartment and the anodic compartment to enable ion exchange therebetween; and a gas-liquid separation unit in fluid communication with the anodic compartment configured to receive the anodic product mixture and to separate the anodic product stream into a $CO_2$-depleted liquid stream and a pure gaseous $CO_2$ stream.

Particularly, the present disclosure relates to a $CO_2$RR/OOR system utilizing a stream of $CO_2$ (as only/major/minor component) as a feedstream to the cathode to produce a stream of pure $CO_2$ at the anode outlet while electrochemically converting a portion of cathode-fed gaseous carbon dioxide ($CO_2$) stream to multi-carbon products ($C_{2+}$) being $CO_2$RR products.

Surprisingly, the system and process of the present disclosure optimizes the $CO_2$ utilization, by recovering it at the anodic compartment. There is for provide a $CO_2$RR/OOR MEA electrolyser which allows the anodic reaction to being all liquid in nature—i.e., to avoid any $O_2$ evolution from $CO_2$-to avoid contamination of the anodic product stream (including $CO_2$) with Oz. A $CO_2$ stream of high purity (>99%), and referred to as a pure $CO_2$ stream, can then be recovered by gas-liquid separation of the anodic product stream and can further be directly recycled to the cathodic to yield multi-carbon products (such as ethylene) as part of a cathodic product stream. Controlling the anodic reaction allows achieving higher $CO_2$ utilization than the conventional 25% $CO_2$ utilization threshold, to avoid an energy consumption penalty associated with supplemental anodic gas separation, without incurring penalties to a full-cell voltage or a selectivity to ethylene.

Advantageously, the organic oxidation reaction catalyst of the anode comprises carbon and a metal selected from platinum, nickel, iron, cobalt, palladium or lead.

For example, the $CO_2$ concentration of the gaseous $CO_2$-containing stream at the cathode is between 1 vol. % and 100 vol. % based on the total volume of said gaseous $CO_2$ feedstream, or between 5 vol. % and 95 vol. %, or between 10 vol. % and 90 vol. %.

The electrolyser for electrochemically converting a gaseous carbon dioxide stream to multi-carbon products having at least two carbon atoms is catholyte-free. For example, the electrolyser for electrochemically converting a gaseous carbon dioxide stream to multi-carbon products having at least two carbon atoms is an anolyte-containing one-gap electrolyser. For example, the electrolyser for electrochemically converting a gaseous carbon dioxide stream to multi-carbon products having at least two carbon atoms is a zero-gap electrolyser, such as a membrane electrode assembly (MEA) electrolyser.

Particularly, the organic oxidation reaction catalyst can be a glucose oxidation reaction catalyst. Such oxidation reaction leads to liquid products, namely gluconate, glucuronate, glucarate or a mixture thereof. This favours therefore the implementation of the gas-liquid separation unit in a way to further optimize the recovery of the gaseous $CO_2$. For example, the organic oxidation reaction (OOR) catalyst of the anode can include carbon and a metal selected from platinum, nickel, iron, cobalt, palladium or lead. For example, the OOR catalyst of the anode can include carbon and platinum. Optionally, the organic oxidation reaction catalyst of the anode can have a catalyst loading between 0.1 $mg/cm^2$ and 10 $mg/cm^2$, between 0.1 $mg/cm^2$ and 4.0 $mg/cm^2$, or between 0.3 $mg/cm^2$ and 2.0 $mg/cm^2$. For example, the anode can have a carbon loading between 0.5 $mg/cm^2$ and 60 $mg/cm^2$, or between 1 $mg/cm^2$ and 50 $mg/cm^{-2}$.

The anode can also include a hydrophilic porous support. For example, the hydrophilic porous support is a carbon fibre cloth substrate or a PTFE non-woven cloth pre-sputtered by metal. Optionally, the anode can further include an ionomer layer. For example, the ionomer of the ionomer layer can be a perfluorinated sulfonic acid ionomer such as a perfluorosulfonic acid (PFSA) ionomer.

For example, the $CO_2$ reduction reaction catalyst of the cathode can be or include a transition metal selected from copper, silver, gold, tin, cobalt, zinc and their alloys. Optionally, the $CO_2$ reduction reaction catalyst of the cathode can have a catalyst loading between 0.1 $mg/cm^{-2}$ and 6.0 $mg/cm^2$; between 0.5 $mg/cm^2$ and 3.0 $mg/cm^2$, or between 1.0 $mg/cm^2$ and 2.0 $mg/cm^{-2}$.

The cathode can further include a hydrophobic porous support. For example, the hydrophobic porous support is a polytetrafluoroethylene (PTFE) support. Optionally, the cathode can further include an ionomer layer. For example, the ionomer of said ionomer layer can be a perfluorinated sulfonic acid ionomer such as a perfluorosulfonic acid (PFSA), poly(aryl piperidinium) or polystyrene methyl methylimidazolium chloride ionomer.

Advantageously, the anodic compartment comprises a solution including an anolyte and an organic liquid-phase precursor of the organic oxidation reaction. For example, the anolyte can be selected from $KHCO_3$, $K_2CO_3$, $NaHCO_3$, $Na_2CO_3$, and any mixture thereof. With preference, the anolyte is or comprises $KHCO_3$.

For example, the organic liquid-phase precursor can be or comprise one or more selected from glucose, glycerol, furfural, 5-hydroxymethylfurfural, starch, cellulose, lignin, alcohols (such as ethanol, n-propanol, iso-propanol, methanol or benzyl alcohol), and any combinations thereof. For example, the organic liquid-phase precursor is or comprises one or more selected from glucose, glycerol, furfural, 5-hydroxymethylfurfural, ethanol, n-propanol, iso-propanol, methanol, benzyl alcohol, starch, cellulose, lignin and any mixtures thereof. With preference, the liquid-phase precursor is or comprises glucose.

For example, the organic liquid-phase precursor of an organic oxidation reaction is a liquid-phase precursor of a glucose oxidation reaction.

For example, the organic liquid-phase precursor of the organic oxidation reaction has an active organic concentration ranging between 0.01 M and 1.5 M. For example, the active organic concentration is ranging between 0.1 M and 1.5 M in the solution; preferably between 0.2 M and 1.2 M; or between 0.5 M and 1.0 M; or between 0.5 M and 1.5 M.

Advantageously, the solution comprising the anolyte and the organic liquid-phase precursor can have a bulk pH between 4 and 9.

In some implementations, the ionic exchange membrane can be an anionic exchange membrane. With preference, said anionic exchange membrane comprises poly(aryl piperidinium) polymer.

The $CO_2RR$/OOR system is a catholyte-free system. For example, the system can be an anolyte-containing one-gap electrolyser. In another example, the system can be a membrane electrode assembly electrolyser.

In some implementations, the $CO_2RR$/OOR system can further include a recycle line in fluid communication with the gas-liquid separation unit to redirect the pure gaseous $CO_2$ stream to the cathodic compartment as a portion of the gaseous $CO_2$-containing stream.

For example, the process can be carried out at a temperature ranging between 30° C. and 50° C., or between 40° C. and 50° C.

For example, the gaseous $CO_2$ stream can be a by-product $CO_2$ stream produced from an industrial upstream process; with preference, from the fermentation of glucose to ethanol. In some implementations of the process, the $CO_2$ concentration of the gaseous $CO_2$-containing stream at the cathode can be between 1 vol. % and 100 vol. % based on the total volume of said gaseous $CO_2$ feedstream, or between 5 vol. % and 95 vol. %, or between 10 vol. % and 90 vol. %.

For example, the anodic product stream further comprises one or more liquid products. The OOR liquid-phase products can include gluconate, glucuronate, glucarate, formate, tartarate, tratronate, or a mixture thereof.

In some implementations of the process, redirecting the recovered pure gaseous $CO_2$ stream to the cathodic compartment as a portion of the gaseous $CO_2$-containing stream can be performed to maximize $CO_2$ utilization.

In some other implementations of the process, redirecting the recovered pure gaseous $CO_2$ stream as a feedstream to another electrolyser can be performed, with the other electrolyser being a solid oxide electrolyser cell, a membrane electrode assembly electrolyser, an alkaline flow cell or any combination thereof.

It should be noted that all implementations herein with respect to the $CO_2RR$-OOR system can be applied/combined with any implementations described in relation to the process.

For example, the multi-carbon products are or comprise ethylene.

While the disclosure will be described in conjunction with example embodiments and implementations, it will be understood that it is not intended to limit the scope of the disclosure to such embodiments or implementations. On the contrary, it is intended to cover all alternatives, modifications and equivalents as may be included as defined by the present description. The objects, advantages and other features of the present disclosure will become more apparent and be better understood upon reading the following non-restrictive description of the disclosure, given with reference to the accompanying drawings.

BRIEF DESCRIPTION OF THE DRAWINGS

Implementations of the $CO_2$RR-OOR system and related process are represented in and will be further understood in connection with the following figures.

DEFINITIONS

Figure 1:
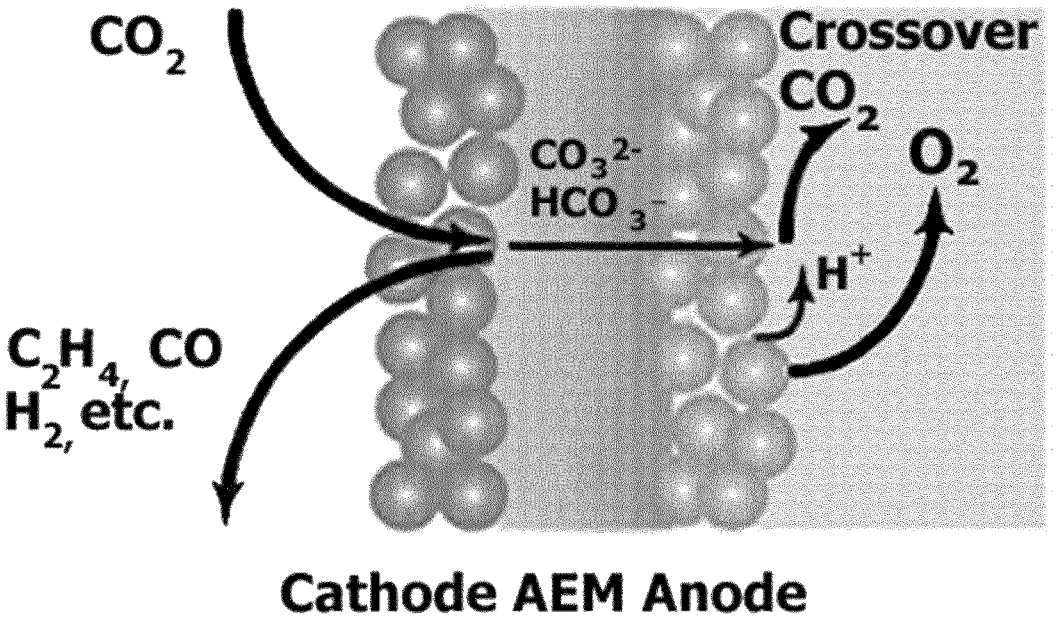
FIG. 1 illustrates the performance of an all-liquid anode enabling $CO_2$ recycling and low energy intensity for producing ethylene, including the mass balance of the electrochemical process in the conventional $CO_2$RR-OER electrolysers.

For the disclosure, the following definitions are given:

As used herein, the term "C#hydrocarbons", wherein "#" is a positive integer, is meant to describe all hydrocarbons having #carbon atoms. C#hydrocarbons are sometimes indicated as just C#. Moreover, the term "C#+ hydrocarbons" is meant to describe all hydrocarbon molecules having #or more carbon atoms. Accordingly, the expression "$C_{2+}$ hydrocarbons" is meant to describe a mixture of hydrocarbons having 2 or more carbon atoms.

The term "transition metal" refers to an element whose atom has a partially filled d sub-shell, or which can give rise to cations with an incomplete d sub-shell (IUPAC definition) . According to this definition, the transition metals are Sc, Ti, V, Cr, Mn, Fe, Co, Ni, Cu, Zn, Y, Zr, Nb, Mo, Tc, Ru, Rh, Pd, Ag, Cd, La, Hf, Ta, W, Re, Os, Ir, Pt, Au, Hg, Ac, Rf, Db, Sg, Bh, Hs, Mt, Ds, Rg, and Cn. The metals Ga, In, Sn, TI, Pb and Bi are considered as "post-transition" metal.

The yield to particular chemical compounds is determined as the mathematical product between the selectivity to said particular chemical compounds and the conversion rate of the chemical reaction. The mathematical product is expressed as a percentage.

The terms "comprising", "comprises" and "comprised of" as used herein are synonymous with "including", "includes" or "containing", "contains", and are inclusive or open-ended and do not exclude additional, non-recited members, elements or method steps. The terms "comprising", "comprises" and "comprised of" also include the term "consisting of".

The recitation of numerical ranges by endpoints includes all integer numbers and, where appropriate, fractions subsumed within that range (e.g., 1 to 5 can include 1, 2, 3, 4, 5 when referring to, for example, a number of elements, and can also include 1.5, 2, 2.75 and 3.80, when referring to, for example, measurements). The recitation of endpoints also includes the recited endpoint values themselves (e.g., from 1.0 to 5.0 includes both 1.0 and 5.0). Any numerical range recited herein is intended to include all sub-ranges subsumed therein.

The particular features, structures, characteristics or embodiments may be combined in any suitable manner, as would be apparent to a person skilled in the art from this disclosure, in one or more embodiments.

DETAILED DESCRIPTION

Electrochemical reduction of $CO_2$ to multi-carbon products ($C_{2+}$), when powered using renewable electricity, offers a route to valuable chemicals and fuels. In conventional zero-gap, neutral-media $CO_2$-to-$C_{2+}$ devices, over 70% of input $CO_2$ crosses the cell to the anodic side where $CO_2$ is mixed with produced oxygen at the anode to form a gaseous product mixture. This amount of $CO_2$ that migrates to the anodic side can be referred to as the crossover $CO_2$. Recovering $CO_2$ from the formed gaseous product mixture (which contains $CO_2$ and oxygen) incurs a significant energy penalty.

There is thus proposed herein a liquid-to-liquid anodic system and related processes that can be implemented to facilitate the capture of crossover $CO_2$ without additional energy input. The techniques encompassed herein can be used to achieve a high carbon efficiency while being compatible with highly-performing $CO_2$ reduction reaction catalysts and electrolysers that are already developed to work optimally in neutral and alkaline electrolytes. For example, the performance of the proposed system can be characterized by a low full-cell voltage of about 1.9 V and a total carbon efficiency of about 48%, for achieving production of about 259 GJ/tonne ethylene, with a 30% reduction in energy intensity compared to state-of-art $CO_2$-to-$C_{2+}$ systems.

More particularly, it is proposed herein to pair a $CO_2$ reduction reaction ($CO_2RR$) with an all-liquid anodic reaction (e.g., organic oxidation reaction (OOR)) in a neutral electrolyte to achieve high carbon efficiency and low energy input in the electrosynthesis of renewable chemicals and fuels. The present techniques enable recovery of the crossover $CO_2$ as a stream of pure gaseous $CO_2$ which can be used in various ways including (1) being stored, (2) being recycled to the cathode for utilization in the $CO_2RR$-OOR electrolyser or (3) being fed into any other electrolyser for the production of CO, C1 products, C2+ products, or any combinations thereof. Examples of combinations of electrolysers are described further below with reference to FIGS. 3 to 6. Alternatively, the stream of pure $CO_2$ can be used as an industrial source of $CO_2$ or transported for geological storage.

Figure 3:
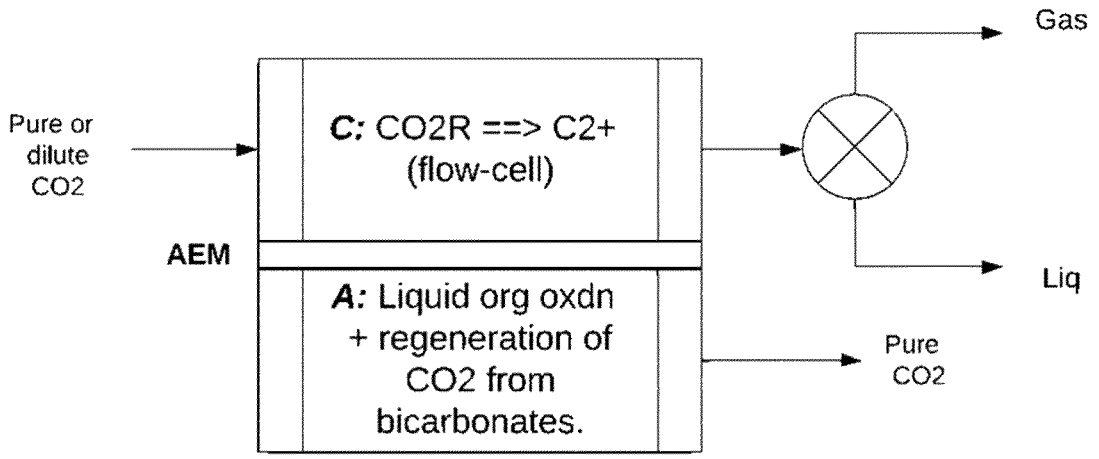
FIG. 3 is a schematic representation of a conceptual design of $CO_2$-ORR MEA electrolyser operating organic oxidation reaction like GOR and reduction of $CO_2$ contained in a stream of pure or diluted $CO_2$, and allowing recovery of crossover $CO_2$ as a pure gaseous $CO_2$ stream.

Referring to FIG. 3, the $CO_2RR$-OOR system can include an anodic compartment (A) sustaining all liquid oxidation reactions (OOR) and a cathodic compartment (C) sustaining $CO_2$ reduction into multi-carbon products, with the anodic compartment and the cathodic compartment being separated by an anion exchange membrane (AEM). The process includes feeding the gaseous $CO_2$-containing stream, that can be a pure or dilute $CO_2$ stream, to the cathodic compartment to generate a cathodic product mixture comprising multi-carbon products via electrochemical reduction from the cathodic compartment, and an anodic product mixture comprising $CO_2$ and OOR products from the anodic compartment. The process further includes gas-liquid separation of the anodic product mixture into a $CO_2$-depleted liquid stream and a pure gaseous $CO_2$ stream (corresponding to the crossover $CO_2$). It should be noted that the $CO_2$-depleted liquid stream can be recycled as a portion of the anolyte.

For example, the $CO_2RR$-OOR electrolyser can be a zero-gap $CO_2RR$-OOR electrolyser or a one-gap $CO_2RR$-OOR electrolyser (flow cell).

Experimentation in operating the proposed $CO_2RR$-OOR electrolyser and related system implementations demonstrated a high carbon efficiency by returning the recovered crossover $CO_2$ to the cathodic gaseous $CO_2$-containing stream, thereby achieving a high $CO_2$ conversion of up to 75%. It was further shown that the proposed $CO_2RR$-OOR electrolyser can achieve a low full-cell potential of 1.90 V at a current density of 100 mA $cm^{-2}$ and stable electrosynthesis of $C_{2+}$ products for over 80 hours while maintaining a high $CO_2$ conversion of 45%. Accounting for the total electricity and downstream separation energy costs, the present techniques achieve a total energy intensity of 259 GJ per ton of ethylene produced, approximately 30% lower than that of known $CO_2RR$ electrolysers.

Process and System Design to Facilitate Recovery of Crossover $CO_2$

The techniques described herein facilitate direct recovery of pure $CO_2$ from the anodic product mixture that is generated from a neutral/alkaline electrolyte media and can apply to a $CO_2RR$-OOR electrolyser including a cathodic compartment comprising a cathode supporting $CO_2$ reduction reactions, an anodic compartment comprising an anode supporting organic oxidation reactions in a neutral/alkaline media containing an organic liquid-phase precursor, and an anionic exchange membrane (AEM) ensuring anionic exchange between the two compartments.

Figure 7:
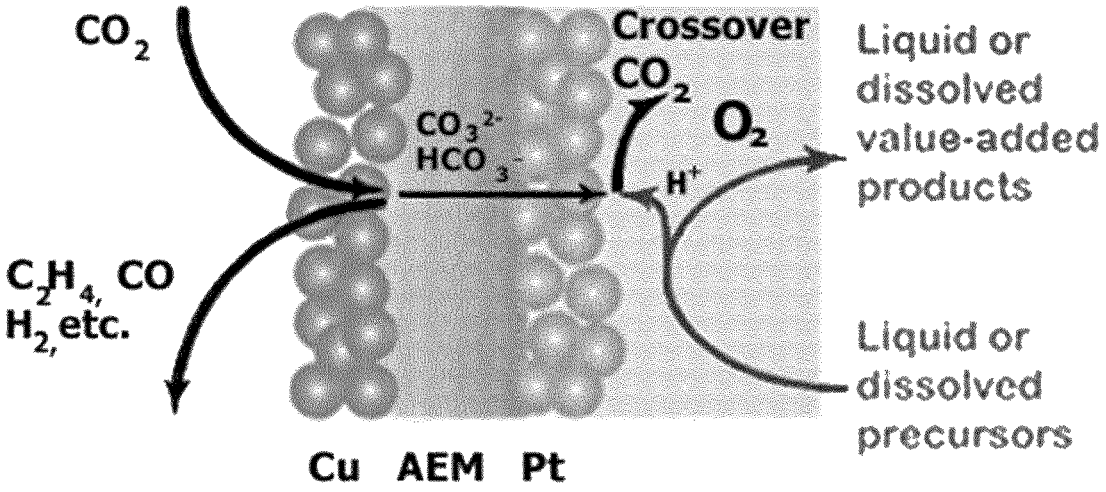
FIG. 7 is a schematic representation of a $CO_2$RR-OOR MEA electrolyser operating all-liquid anodic reactions facilitating gaseous $CO_2$ recycling and enabling low energy intensity for producing ethylene.

For example, the present system can be a zero-gap $CO_2RR$-OOR MEA electrolyser. Referring to FIG. 7, the cathodic compartment of the $CO_2RR$-OOR MEA electrolyser is continuously supplied with $CO_2$ via the gaseous $CO_2$-containing stream. FIG. 7 further provides the mass balance of the electrochemical process in the $CO_2RR$-OOR MEA electrolyser. The anodic compartment is configured to receive a near-neutral anolyte (e.g. 1 M $KHCO_3$) containing the organic liquid-phase precursor that can be electrochemically oxidized to value-added liquid-phase products according to organic oxidation reactions (OOR), and being thereof referred to as OOR liquid-phase products. The MEA-type electrolyser uses a Cu-loaded gas diffusion electrode as the cathode, and a Pt/C loaded hydrophilic carbon cloth as the anode, an anion-exchange membrane (AEM) as a solid-state electrolyte. At the cathode, a small portion of $CO_2$ (<25 vol. %) is electrochemically converted to the $CO_2RR$ products, and a significant fraction of $CO_2$ (50-75 vol. %) is converted to carbonate/bicarbonate due to its reaction with locally produced hydroxide (OH) ions (see the study of Larrazábal G. O., et al, entitled "*A comprehensive approach to investigate $CO_2$ reduction electrocatalysts at high current densities*" (*Acc. Mater. Res.*, 2021, 2, 220-229). The carbonate/bicarbonate ions then migrate to the anode through the AEM. At the anode, the organic liquid-phase precursor is electrochemically oxidized to value-added product(s) in the near-neutral anolyte and generates protons. The protons combine with the carbonate/bicarbonate ions, regenerating crossover $CO_2$ as the only gas-phase product at the anodic product stream.

Other examples of near-neutral anolyte are anolytes selected from $K_2CO_3$, $NaHCO_3$, $Na_2CO_3$ and any mixture thereof.

$CO_2RR$ products refer herein to multi-carbon products having at least 2 carbon atoms. $CO_2RR$ products for example include ethylene.

The AEM separates the cathode and the anode and further provides highly alkaline conditions favourable for $CO_2RR$. Referring to FIGS. 1 and 7, both the present system (FIG. 7) and conventional AEM-based zero-gap $CO_2RR$ electrolyser system (FIG. 1) allow a large portion of the input $CO_2$ (e.g., 70 vol. %) crossing over the AEM from the cathode to the anode under the form of carbonate and bicarbonate ions. Such crossover ions can further combine with the protons generated from the reaction at the anode (anodic reaction) to regenerate gaseous $CO_2$. The present techniques include controlling the anodic reaction to being all liquid in nature—i.e., to avoid any $O_2$ evolution from $CO_2$—to avoid contamination of the anodic product stream (including $CO_2$) with $O_2$. The anodic product mixture is a gas-liquid mixture with the $CO_2$ making up for substantially all the gas phase and the OOR products comprised in the liquid phase.

Figure 8:
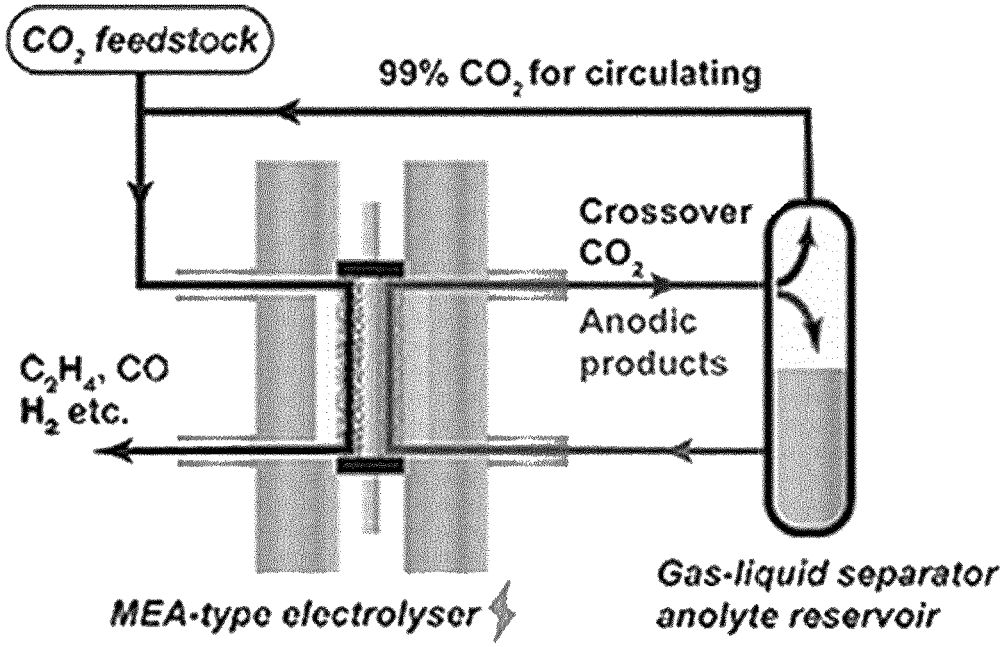
FIG. 8 illustrates the performance of an all-liquid anode enabling $CO_2$ recycling and low energy intensity for producing ethylene, including the operating principle of the $CO_2$RR-OOR electrolysis system that combines low-energy input and high-carbon utilization in $CO_2$-to-$C_{2+}$ conversion. The system uses an anolyte composed of $KHCO_3$ and liquid organic precursors. The cathode chamber is fed with humidified $CO_2$.

The process can include separating the anodic product mixture into a pure gaseous $CO_2$ stream (purity >99%) and a $CO_2$-depleted liquid stream (that can be recycled as liquid anolyte remainder). Referring to FIG. 8, the pure gaseous $CO_2$ stream can be recovered by gas-liquid separation of the anodic product stream in a gas-liquid separator serving as an anolyte reservoir, and the pure gaseous $CO_2$ stream can further be directly recycled to the cathodic compartment (see recycle line for circulating recovered 99% $CO_2$ stream in FIG. 8) to yield ethylene as part of a cathodic product mixture. Thus, controlling the anodic reaction to remain in liquid phase allows achieving higher $CO_2$ utilization than the conventional 25% $CO_2$ utilization threshold, and avoiding an energy consumption penalty associated with supplemental anodic gas mixture separation, without incurring penalties to a full-cell voltage or a selectivity to ethylene.

All-Liquid-Phase Anodic Process

The present techniques allow all-liquid-phase anodic reactions that produce protons (or consume hydroxides) and operate in near-neutral media. Candidate anode reactions include water-to-hydrogen peroxide, chloride-to-hypochlorite, and a wide range of organic oxidation reactions (OORs). However, known catalysts for hydrogen peroxide and hypochlorite production can result in gaseous by-products.

Coupling electrochemical CO reduction with OOR has been demonstrated in an MEA electrolyser. However, prior systems that employed OOR as an anodic reaction did not focus on overall carbon efficiency: recent gas-$CO_2$-fed $CO_2$RR-OOR systems operated in strong alkaline electrolytes (pH>14), causing a severe energy penalty associated with the regeneration of (bi) carbonate back to alkaline and $CO_2$.

The process thus includes controlling the anodic reaction to favour OORs at the anode at a neutral/alkaline pH. A neutral/alkaline anolyte/electrolyte/media refers herein to an anolyte/electrolyte/media having a neutral/alkaline pH, i.e., a pH between 4 and 9, optionally between 4 and 8, and further optionally between 4.5 and 7.5. The OORs that are encompassed herein include the oxidation of glucose, glycerol, furfural, 5-hydroxymethylfurfural, starch, cellulose, lignin, and alcohols.

In some implementations, controlling the anodic reaction can include favouring a glucose oxidation reaction (GOR) in a neutral/alkaline anolyte. Coupling the $CO_2$RR with GOR is demonstrated herein as a suitable liquid-phase anodic process strategy for high-carbon efficiency and low-energy intensity in $CO_2$-to-$C_{2+}$ conversion. Favouring the GOR includes providing glucose as a liquid precursor in the anolyte.

Figure 9:
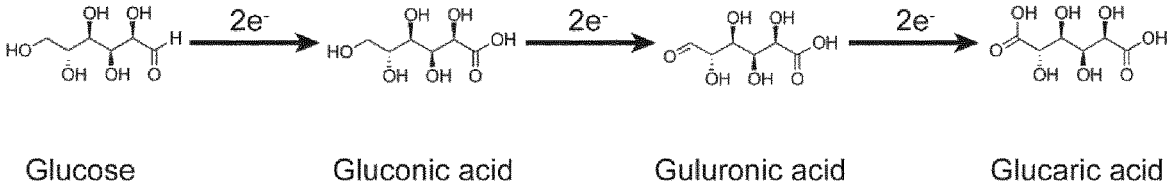
FIG. 9 is a schematic representation of the main mechanism of the electrochemical glucose oxidation reaction (GOR).

Glucose is abundant in biomass, with an average market price of $400-500 ton-1, mainly produced from starch. In 2017, over 5 million tons of glucose were produced in the United States. Electrochemical oxidation of glucose mainly produces gluconate, glucuronate, and glucarate (FIG. 9), which command a higher market price per ton than does the input chemical glucose, for they function as feedstocks for the production of biopolymers and pharmaceuticals. The market price of gluconic acid reaches $1,500 ton-1. Glucaric acid is a high-value-added biomass-derived commodity chemical. The projected market sizes of gluconic acid and glucaric acid are $1.9 billion (2028) and $1.3 billion (2025). The recent techno-economic assessment estimated that the separation process of the GOR product requires 3.6 to 4.5 GJ per ton of input glucose, acceptable at $60 to $75 per ton assuming an electricity price of $0.06 kWh-1 compared to the market price of the GOR products.

The GOR that is selected herein avoids gaseous products, thereby facilitating the recovery of pure gaseous $CO_2$ from the anodic product mixture via direct gas-liquid separation. The selected GOR can outcompete the oxygen evolution reaction (OER) at industrially relevant reaction rates in electrolytes having a pH between 4 and 9, between 4 and 8, or between 4.5 and 7.5. The selected GOR also offers electrolysis energy savings, with a thermodynamic potential of 0.05 V, significantly lower than that of the OER (1.23 V). A large supply of each reactant, $CO_2$ and glucose, is available and co-located in industrial bioethanol plants. In these operations, glucose ferments to ethanol and $CO_2$ is emitted. A 2012 report estimated that 14.8 tons of $CO_2$ is emitted in producing 1 ton of bioethanol. The $CO_2$RR-GOR electrolyser can convert waste $CO_2$ and available glucose to chemicals, providing additional product streams and reducing the overall/net carbon footprint of bioethanol production if it used low-carbon electricity.

Catalyst Characterization

The cathodic compartment of the system includes a cathode that catalyzes the $CO_2$RR. The cathode comprises a catalyst that can be referred to as a $CO_2$RR catalyst. The $CO_2$RR catalyst comprises one or more transition metals, for example, Cu, Ag, Pb, Co, Sn, Zn, and alloys thereof, and/or any combinations thereof. The $CO_2$RR catalyst comprises one or more transition metals in addition to copper, for example, Ag, Pb, Co, Sn, Zn, and alloys thereof, and/or any combinations thereof. For example, the $CO_2$RR catalyst can comprise one or more phthalocyanines of said one or more transition metals. In some implementations, the cathode is a gas diffusion electrode (GDE) that includes hydrophobic porous support. For example, the hydrophobic porous support can comprise polytetrafluoroethylene (PTFE) and/or hydrophobic carbon paper.

Optionally, the cathode can further include an ionomer layer that comprises a perfluorinated sulfonic acid ionomer. The ionomer layer is co-sprayed with catalyst nanoparticles (e.g., copper nanoparticles).

For example, the perfluorinated sulfonic acid ionomer can be Fumion®, Sustainion®, Aquivion®, Pention, or PiperION. For example, the perfluorinated sulfonic acid ionomer can include perfluorosulfonic acid (PFSA), sulfonated tetrafluoroethylene based fluoropolymer-copolymer (such as Nafion® or 1,1,2,2-Tetrafluoroethene; 1,1,2,2-tetrafluoro-2-[1,1,1,2,3,3-hexafluoro-3-(1,2,2-trifluoroethenoxy) propan-2-yl]oxyethanesulfonic acid), SSC, Aciplex, Flemion, 3M-perfluorinated sulfonic acid ionomer, Aquivion, an ionene, or a combination thereof.

Figure 10:
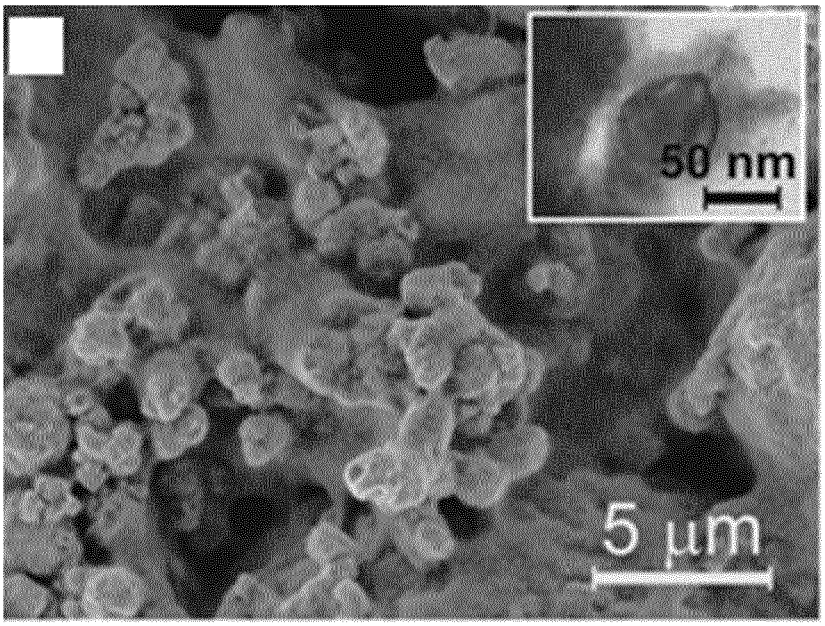
FIG. 10 illustrates an electron microscopy characterization of MEA electrolyser catalysts including scanning electron microscopy (SEM) and transmission electron microscopy (TEM, inset) images of the cathodic catalyst: Cu nanoparticles/PFSA composite.

In some implementations, the cathode can be produced by depositing copper nanoparticles and a perfluorosulfonic acid (PFSA) ionomer on a hydrophobic porous polytetrafluoroethylene (PTFE) support, thereby being referred to as a PTFE gas diffusion electrode. Optionally, the production of the cathode can include pre-sputtering a layer of copper to improve the electrical conductivity thereof. For example, experimental results provided further below include experiments with a cathode being prepared by steps including pre-sputtering a 200 nm-thick polycrystalline Cu layer to improve electrical conductivity (see Experimental Results for details). Referring to the scanning and transmission electron microscopy (SEM and TEM, respectively) of FIG. 10, the produced cathode has a surface morphology composed of copper nanoparticles bonded by several tens of nm-thick PFSA ionomer films.

Figure 11:
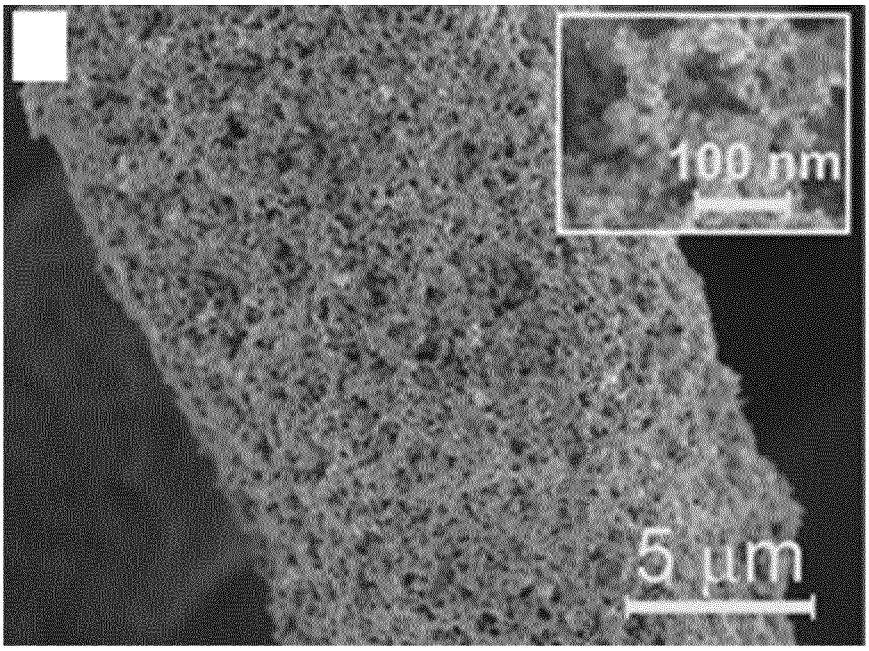
FIG. 11 illustrates an electron microscopy characterization of MEA electrolyser catalysts including SEM images of the anodic catalyst: Pt/C loaded on hydrophilic carbon fibres.
Figure 12:
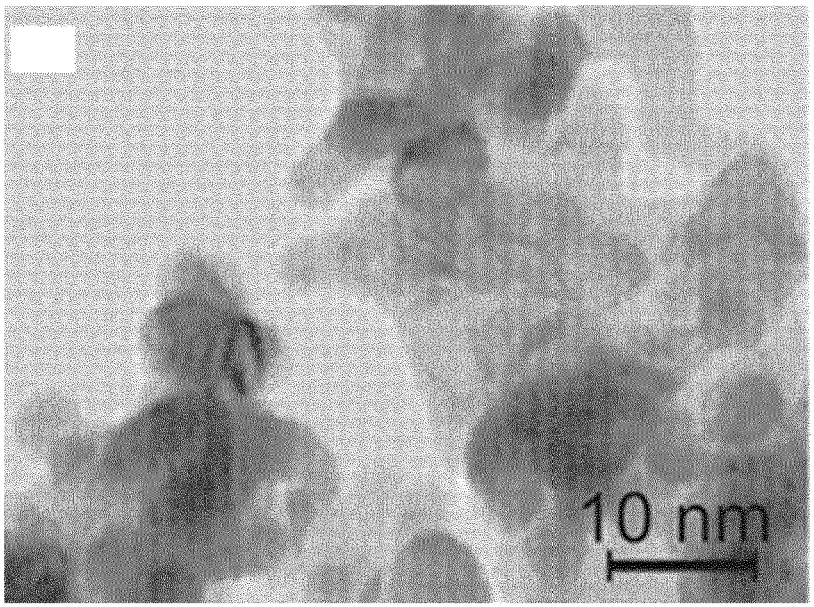
FIG. 12 illustrates an electron microscopy characterization of MEA electrolyser catalysts including SEM images of the Pt/C catalyst.
Figure 13:
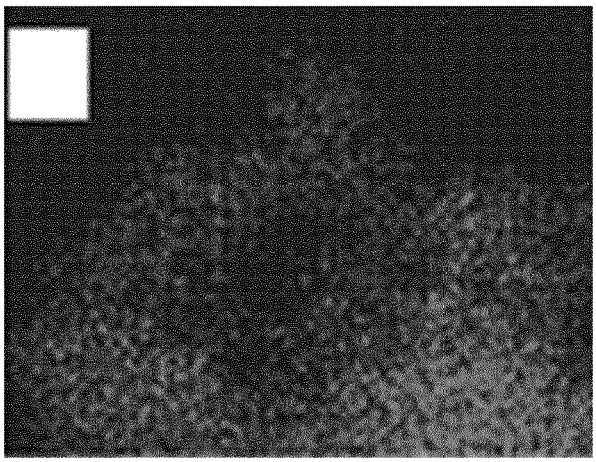
FIG. 13 illustrates an energy-dispersive X-ray spectroscopy (EDS) elemental mappings of carbon for Pt/C catalyst.
Figure 14:
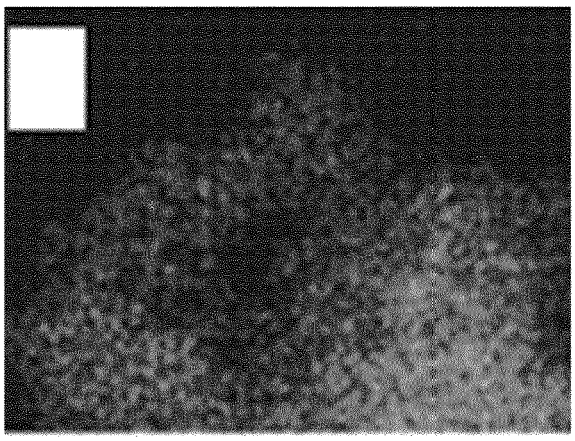
FIG. 14 illustrates an energy-dispersive X-ray spectroscopy (EDS) elemental mappings of overlap for Pt/C catalyst.

The anodic compartment of the system includes an anode that comprises a catalyst that can be referred to as an anodic catalyst. For example, the anodic catalyst can include Pt, $IrO_2$, Pd, Au, $Ni_3P$, Ni—Fe alloys or any combinations thereof. In some implementations, the anode can further include a hydrophilic and porous support. For example, the hydrophilic and porous support can include, without being limited to, a hydrophilic and highly porous carbon fiber cloth substrate, Ti felt, Ni mesh, Cu mesh, or any combination thereof. In some implementations, the anode can further include an ionomer provided as a layer or film to bond the catalyst particles. For example, the anode can be prepared in accordance with the details provided in the Experimental Results section, to comprise a homogeneous blend of Pt/C nanoparticles and PFSA ionomer on a hydrophilic and highly porous carbon fibre cloth substrate. As seen in the SEM image of FIG. 11, the anode can be composed of macroporous carbon fibres that are homogeneously covered by Pt/C nanoparticles and PFSA composites (inset in SEM image of FIG. 11). As seen in the TEM image of FIG. 12, the diameter of Pt nanoparticles can be in the range of 5 to 10 nm. Referring to the energy-dispersive X-ray spectroscopy (EDS) elemental mapping shown in FIGS. 13 and 14, Pt is shown to be evenly distributed on the surface of the carbon nanoparticles.

In some implementations, the cathode can be prepared by depositing copper nanoparticles and a perfluorosulfonic acid (PFSA) ionomer on a hydrophobic porous carbon paper.

In some implementations, the anode can be prepared by depositing metal nanoparticles onto above-mentioned hydrophilic and highly porous substrates via electrochemical deposition or solvent-thermal deposition.

On Engineering Cathode and Anode to Facilitate Ethylene Faradaic Efficiency (FE) and Reduce/Prevent Oxygen FE Simultaneously In some implementations, controlling the anodic reaction can include favouring the OOR by selecting the organic liquid-phase precursor of the anolyte in the group consisting of glucose, glycerol, furfural, 5-hydroxymethylfurfural, alcohols, starch, cellulose lignin, and any mixtures thereof. The alcohols can include ethanol, n-propanol, iso-propanol, methanol or benzyl alcohol, or any mixtures thereof. For example, the liquid precursor of the anolyte can be glucose and controlling the anodic reaction includes favouring a glucose oxidation reaction (GOR). Optionally, the anodic reaction can be further controlled by adjusting an active organic concentration of glucose in the anolyte.

The present techniques allow maintaining a low OER FE to facilitate/maximize GOR FE, and thereby achieving recovery of an anodic gaseous stream being substantially pure $CO_2$. In the present $CO_2$RR-GOR system, the cathodic and anodic catalysts can be tailored to the $CO_2$ recovery strategy.

In some implementations, controlling the anodic reaction to avoid production of gaseous $O_2$ from the crossover $CO_2$ can include at least one of adjusting a catalyst loading of the anode, and adjusting a catalyst loading of the cathode. For example, favouring OOR instead of OER at the anode can include balancing a catalyst loading between the anode and the cathode. For example, the catalyst loading can be a metal loading of the electrode.

In some implementations, controlling the anodic reaction to avoid $O_2$ production by OER can include adjusting the catalyst loading of the anode. For example, the catalyst loading of the anode can be adjusted between 0.1 mg/cm$^2$ and 10 mg/cm$^2$, preferably between 0.2 mg/cm$^2$ and 9.5 mg/cm$^2$, more preferably between 0.4 mg/cm$^2$ and 9 mg/cm$^2$, or between 0.5 mg/cm$^2$ and 5 mg/cm$^2$. The catalyst loading thus depends on the surface area of the anode catalyst. The catalyst loading of the cathode can amount to a range between 20% and 30% of the catalyst loading of the anode, optionally between 22% and 28%. For example, the catalyst loading of the cathode can amount to 25% of the catalyst loading at the anode.

Figure 15:
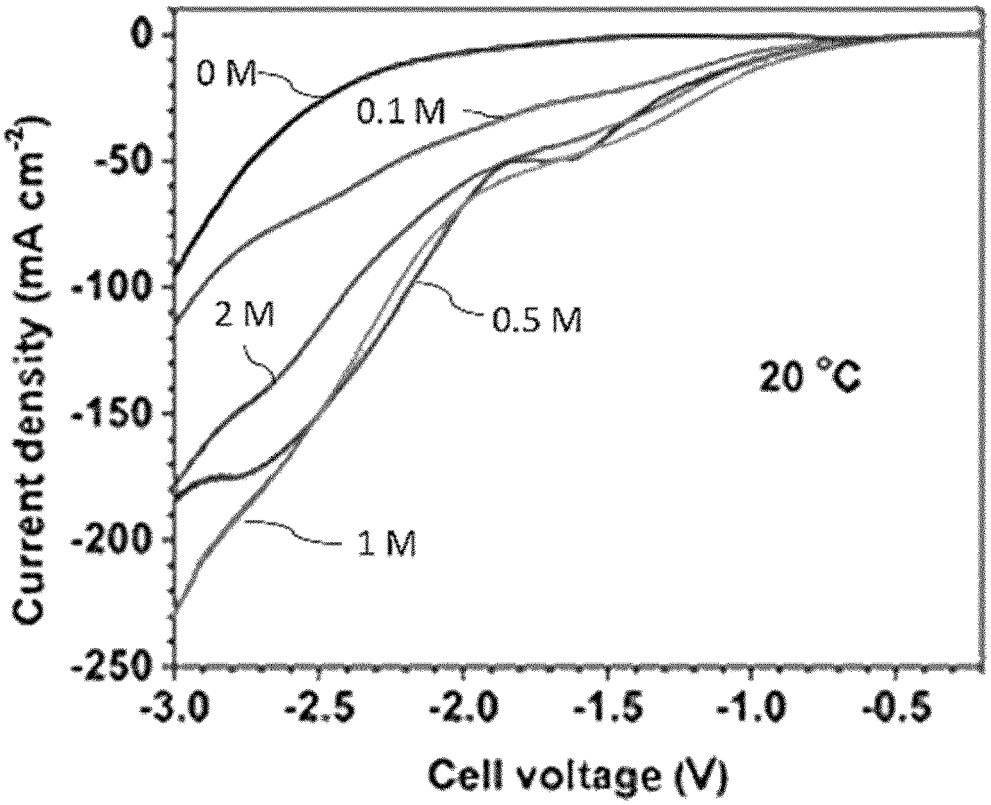
FIG. 15 illustrates the performance of the $CO_2$RR-GOR electrolysis system including copper cathode catalyst and anode platinum catalyst with the mass loading of Cu: 0.5 mg cm 2 and Pt: 2 mg $cm^{-2}$, including the linear scan voltammetry (LSV) of the $CO_2$RR-GOR electrolysis system with various glucose concentrations (0 M refers to $CO_2$RR-OER on a high-surface-area $IrO_x$—Ti catalyst) at 20° C. All the profiles were recorded at a scanning rate of 5 mV $s^{-1}$ immediately after three cycles of voltammetry scanning.
Figure 16:
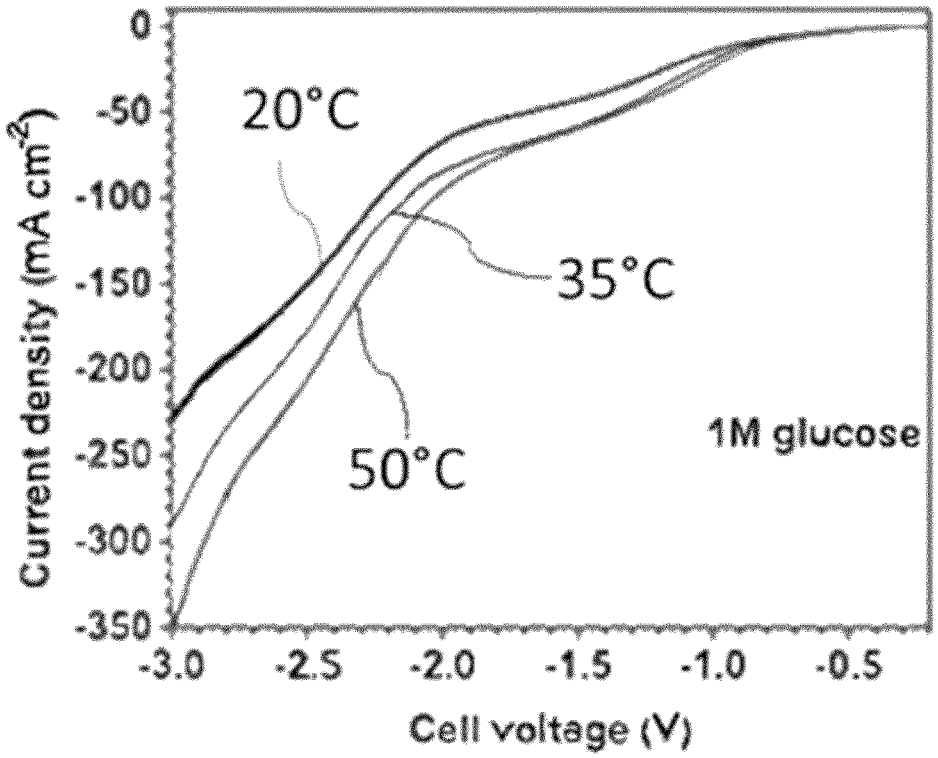
FIG. 16 illustrates the performance of the $CO_2$RR-GOR electrolysis system including copper cathode catalyst and anode platinum catalyst with the mass loading of Cu: 0.5 mg $cm^{-2}$ and Pt: 2 mg $cm^{-2}$, including the linear scan voltammetry (LSV) of the $CO_2$RR-GOR electrolysis system with 1 M glucose at various temperatures. All the profiles were recorded at a scanning rate of 5 mV $s^{-1}$ immediately after three cycles of voltammetry scanning.

Referring to graphs of FIGS. 15 and 16, linear scan voltammetry (LSV) measurements were conducted to investigate the electrochemical response of the $CO_2$RR-GOR system as encompassed herein. The tested $CO_2$RR-GOR system included a cathode having a copper loading of 0.5 mg cm 2 and an anode having a platinum loading of 2 mg cm$^{-2}$. Without adding glucose to the anolyte ($CO_2$RR-OER), the electrolyser delivered a current density of 94 mA cm$^{-2}$ at a full-cell voltage of 3 V. At 100 mA cm$^{-2}$, when glucose was introduced as the liquid precursor of the anolyte, with a glucose concentration gradually increasing from 0.1 M to 0.5 M and 1 M, the full-cell voltage decreased from 2.90 V to 2.18 and 2.23 V. The proximity between the full-cell voltages for the glucose concentrations of 0.5 M and 1 M is attributable to an electrokinetic limitation of the anode. A further increase in the glucose concentration to 2 M increased full-cell voltage, i.e., 2.40 V at 100 mA cm$^{-2}$ due to the excess coverage of Pt with glucose and oxidation intermediates. For example, a 1 M glucose concentration was adopted for further performance investigations.

Figure 17:
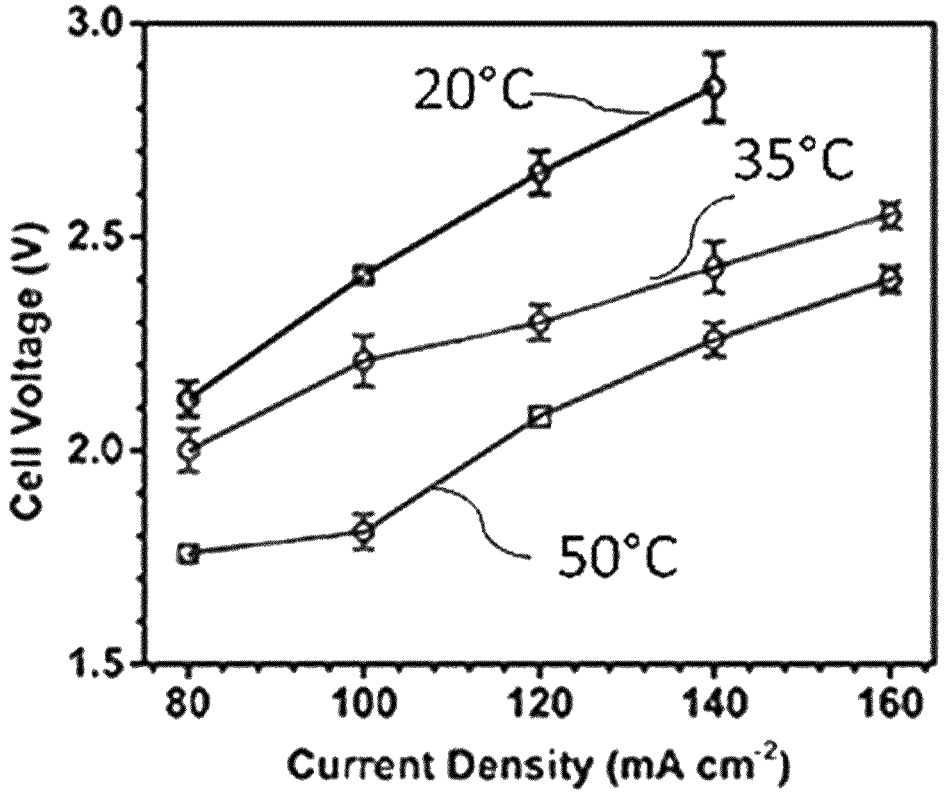
FIG. 17 illustrates the performance of the $CO_2$RR-GOR electrolysis system including copper cathode catalyst and anode platinum catalyst with the mass loading of Cu: 0.5 mg cm 2 and Pt: 2 mg $cm^{-2}$, including the full-cell potential of the $CO_2$RR-GOR at various temperatures.

Referring to the graphs of FIGS. 16 and 17, the LSV and chronopotentiometry measurements were performed to investigate a voltage-current density dependence at various temperatures. Elevating the operating temperature from 20° C. to 35° C. lowers the full-cell voltage by 0.1-0.3 V in a wide range of current densities from 80 mA cm$^{-2}$ to 160 mA cm$^{-2}$ (see FIGS. 16 and 17), attributed to accelerated electrochemical kinetics. A similar full-cell voltage reduction was observed as the operating temperature increased from 35° C. to 50° C. For example, the process can include adjusting an operating temperature between 20° C. and 50° C.

Figure 18:
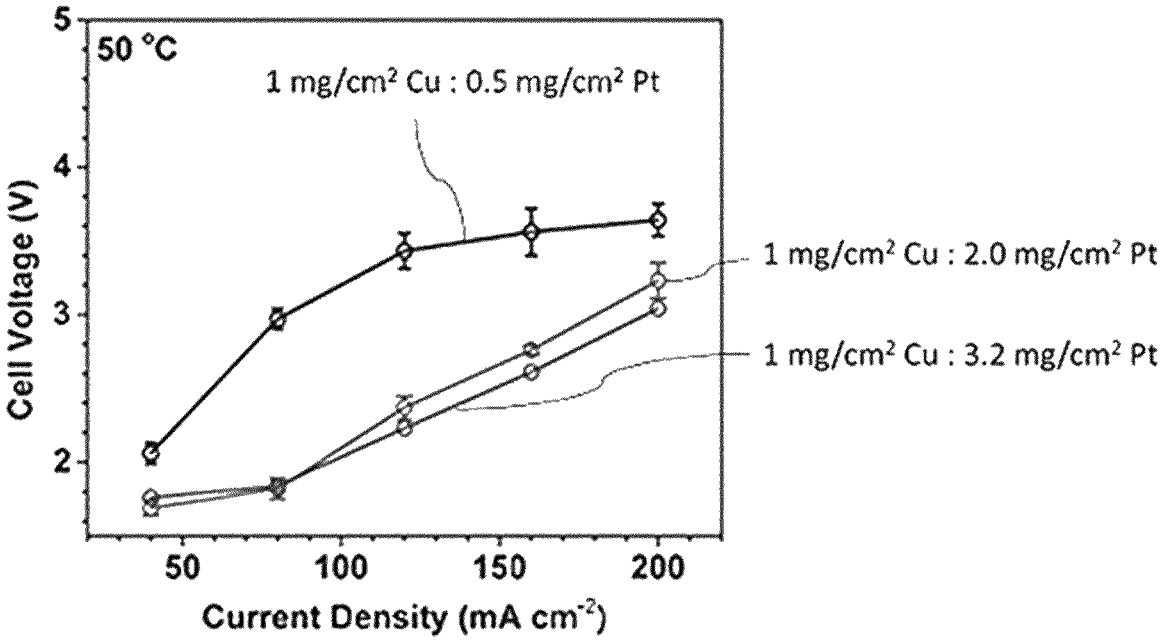
FIG. 18 illustrates the performance of the $CO_2$RR-GOR systems with various cathode and anode catalyst loadings, measured at 50° C., showing the dependences of cell voltage on current density.
Figure 19:
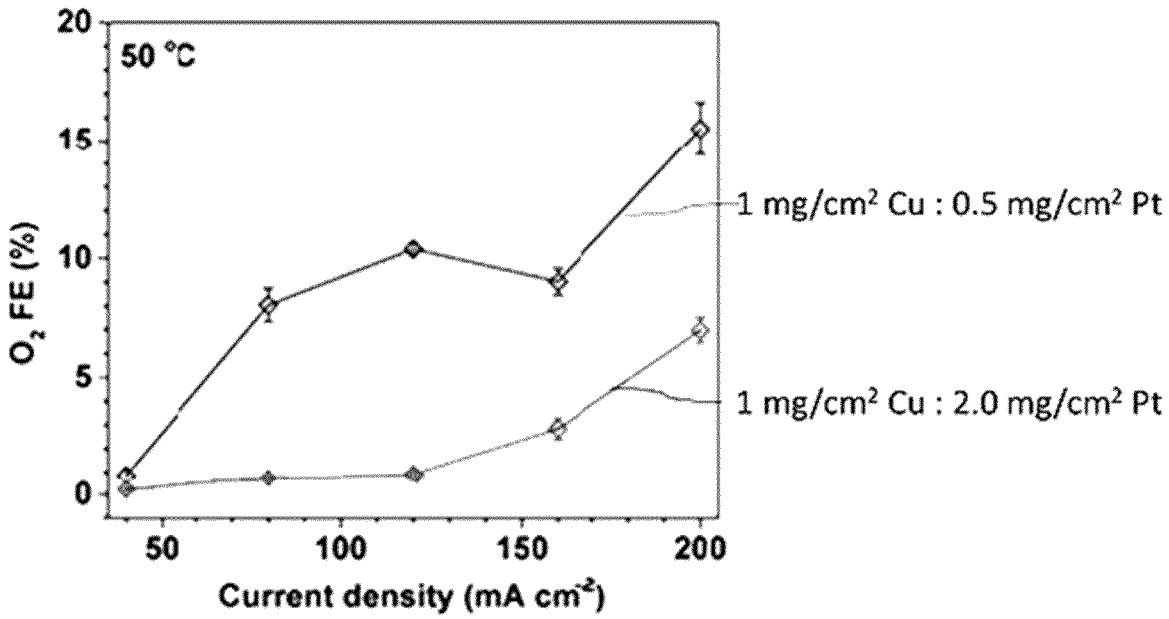
FIG. 19 illustrates the performance of the $CO_2$RR-GOR systems with various cathode and anode catalyst loadings, measured at 50° C., showing the dependences of oxygen FE on current density.

Known catalysts have typical mass loadings that include a cathode Cu loading and an anode Pt loading of 1 mg cm$^{-2}$ and 0.5 mg cm$^{-2}$, respectively. Referring to the graph of FIG. 18, when applying these typical mass loadings in the presently encompassed $CO_2$RR-GOR system, high full-cell voltages of >3.4 V were obtained when seeking to operate above 100 mA cm$^{-2}$, showing little advantage over $CO_2$RR-OER systems. Referring to the graph of FIG. 19, the high full-cell voltage appeared to degrade the selectivity of GOR over OER, leading to an anodic $O_2$ FE of >8%.

The techniques described herein include adjusting a catalyst mass loading on at least one of the cathode and anode to maximize $CO_2$RR product selectivity and minimize anodic OER selectivity simultaneously. Consequently, upon separation of the anodic product mixture, an anodic gaseous stream can be directly recovered with a high purity of >99% in $CO_2$.

Figure 20:
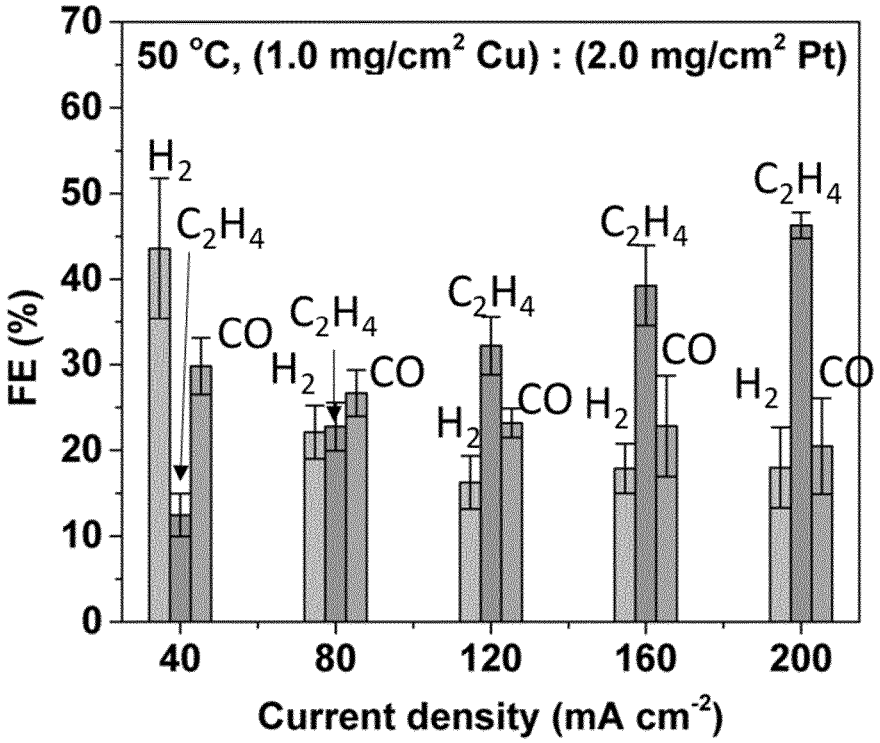
FIG. 20 illustrates the performance of the $CO_2$RR-GOR systems with various cathode and anode catalyst loadings, measured at 50° C., showing the $CO_2$RR gas product distributions at different current densities for an anode catalyst loading of 2.0 mg/$cm^{-2}$.
Figure 21:
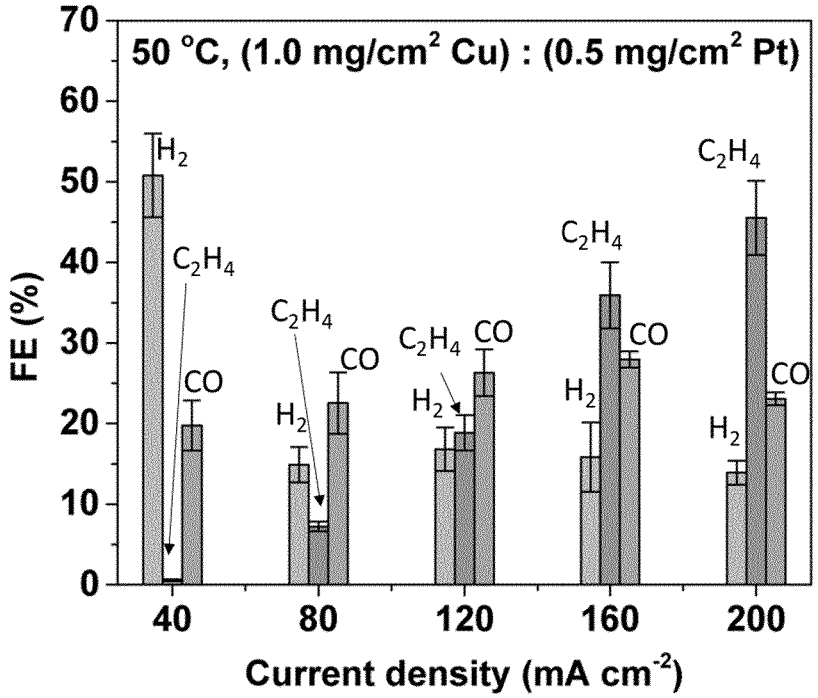
FIG. 21 illustrates the performance of the $CO_2$RR-GOR systems with various cathode and anode catalyst loadings, measured at 50° C., including the $CO_2$RR gas product distributions at different current densities for an anode catalyst loading of 0.5 mg/$cm^{-2}$.
Figure 22:
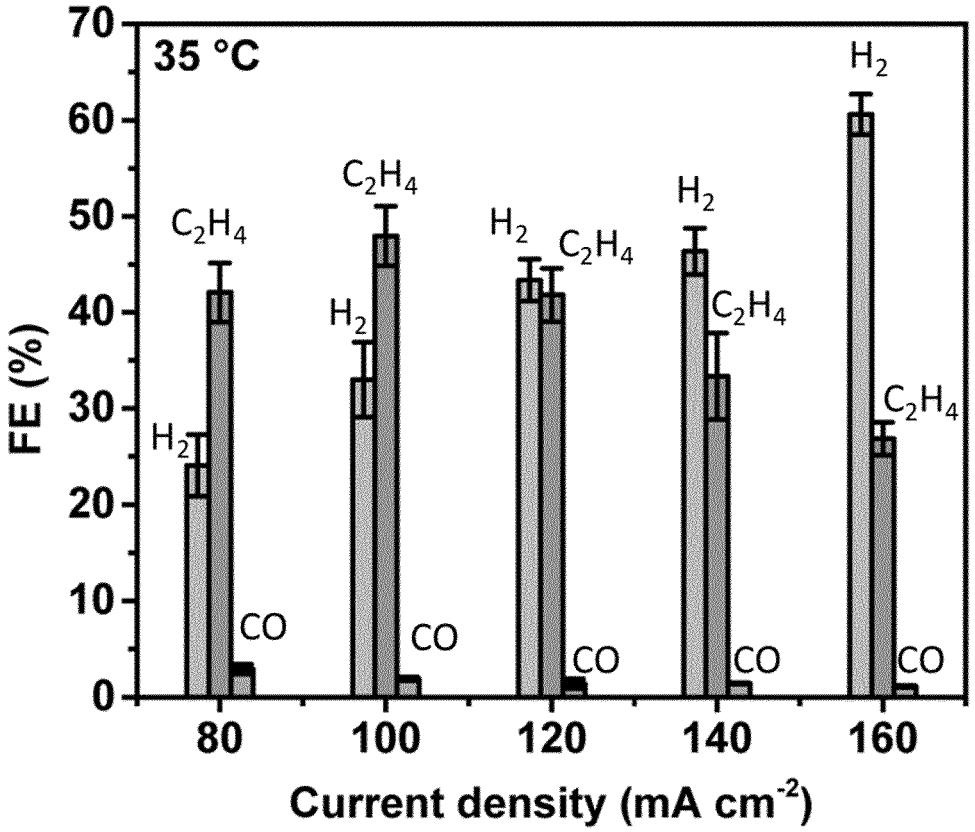
FIG. 22 illustrates the FE distributions toward gas-phase $CO_2$RR products at various current densities, showing measurements at 35° C.
Figure 23:
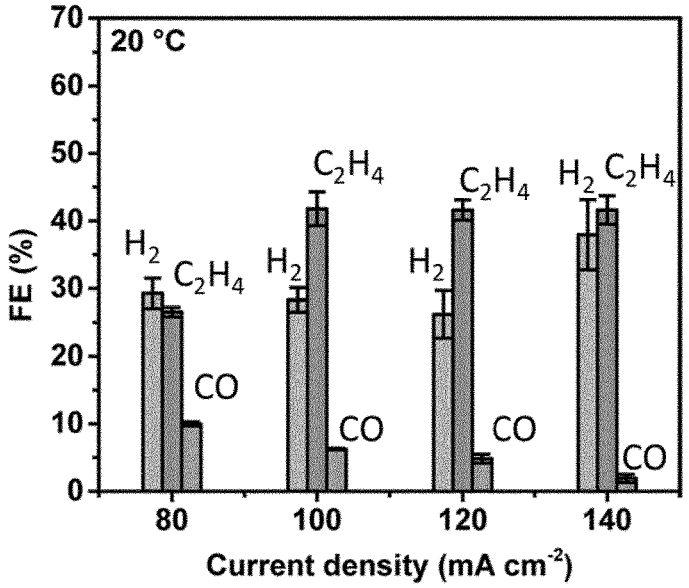
FIG. 23 illustrates the FE distributions toward gas-phase $CO_2$RR products at various current densities, showing measurements at 20° C.
Figure 24:
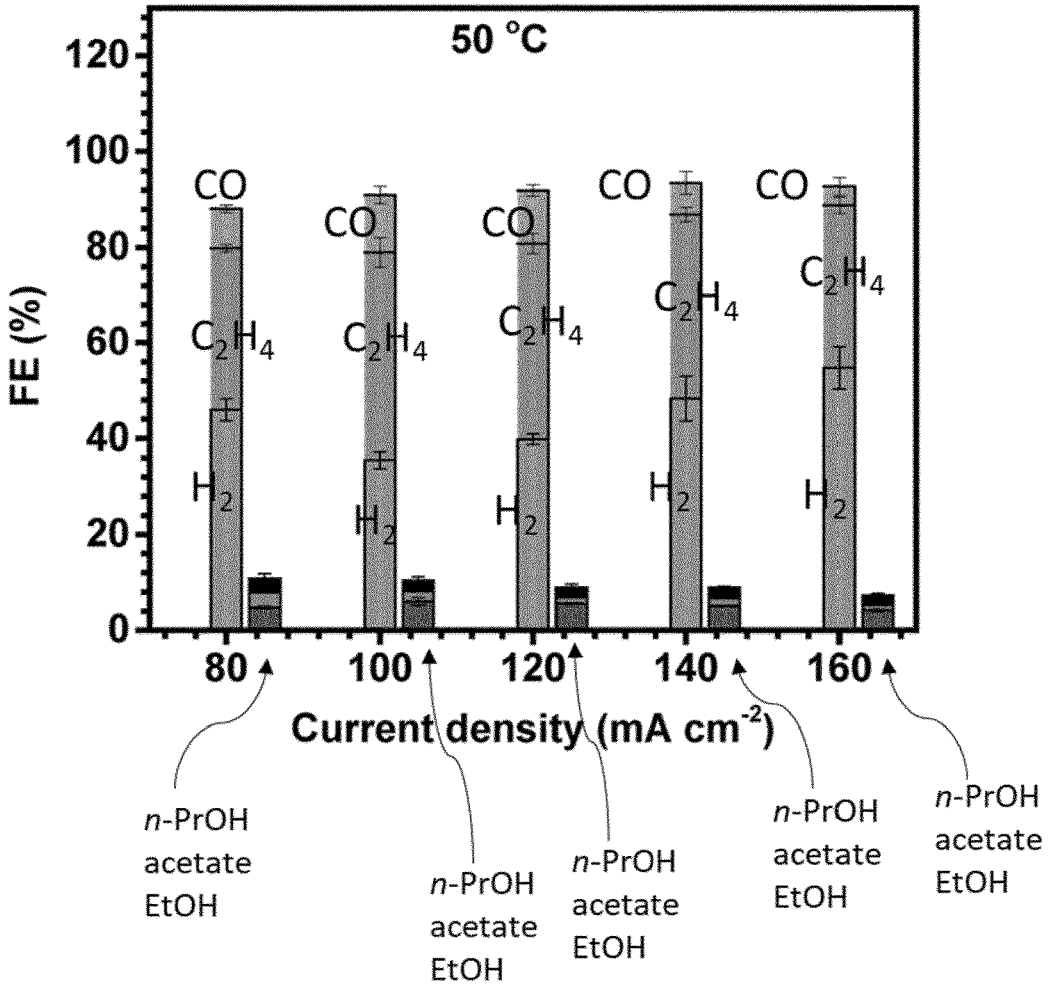
FIG. 24 illustrates the performance of the $CO_2$RR-GOR electrolysis system including copper cathode catalyst and anode platinum catalyst with the mass loading of Cu: 0.5 mg cm-2 and Pt: 2 mg $cm^{-2}$, including the cathodic FE distributions at 50° C. and various current densities.

Controlling the anodic reaction to avoid $O_2$ production by OER can include adjusting the catalyst loading of the anode. For example, referring to FIG. 18, optimizing the Pt loading at the anode was shown to reduce the full-cell voltage to <2.4 V, and consequently the $O_2$ FE to <1% (see FIG. 19) at the current density of 120 mA cm$^{-2}$. However, operating at this current density, the $CO_2$RR selectivity toward ethylene was found to be about 30% (see the graph of FIG. 20), which is significantly lower than the 40-45% benchmark for a copper catalyst at the cathode. To achieve this benchmark, the system was operated at 200 mA cm$^{-2}$ (see FIG. 20) with a full-cell voltage of 3.23V and $O_2$ FE of 7% (see FIGS. 18 and 19). FIG. 20 illustrates the performance of the $CO_2$RR-GOR systems with an anode catalyst loading of 2.0 mg/cm$^2$ while in FIG. 21, the anode loading is 0.5 mg/cm$^{-2}$.

Controlling the anodic reaction to avoid $O_2$ production by OER can further include adjusting the catalyst loading of the cathode. Still referring to FIG. 18, one can see that increasing the $CO_2$RR selectivity toward ethylene cannot be achieved by further increasing the Pt loading, and thus it is proposed herein to adjust both the anode catalyst loading and the cathode catalyst loading, for example in accordance with one another. It was observed that the electrochemical surface area of Pt had reached its maximum at the Pt loading of 2 mg cm-2. Tuning the Cu loading in accordance with the Pt loading changed the current density required to maximize the ethylene FE. In some implementations, the copper loading of the cathode can be 0.5 mg cm$^{-2}$ and the platinum loading of the anode can be 2 mg cm$^{-2}$ to achieve maximum ethylene FE and low oxygen FE simultaneously at industrial-relevant current densities.

The anode can further have a carbon loading with the carbon serving as a conductor and/or substrate for the metal catalyst, such as Pt. For example, the carbon loading of the anode can be further adjusted between 0.5 mg/cm$^2$ and 60 mg/cm$^2$, preferably between 1 mg/cm$^2$ and 50 mg/cm$^2$. For example, the anodic carbon to catalyst ratio can be ranging between 2 and 10, between 3 and 9, or between 4 and 8.

Recycling $CO_2$

The present techniques facilitate the use of a dilute stream of $CO_2$ as the gaseous $CO_2$-containing stream being the $CO_2$RR-OOR electrolyser feedstream, and recovering the crossover $CO_2$ as a stream of pure $CO_2$. The stream of pure $CO_2$ can be further fed to an electrolyser to produce CO and/or other multi-carbon products ($C_{2+}$). A combination of electrolysers can be referred to herein as an assembly of electrolysers.

Figure 4:
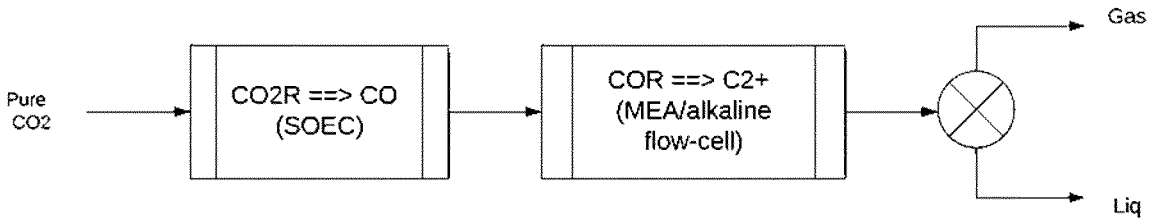
FIG. 4 is a schematic process flow diagram of a solid oxide electrolyser cell (SOEC) that is fed with the pure gaseous $CO_2$ stream generated in the anodic side of the system of FIG. 3 to produce CO at high-temperature (i.e., above 350° C.), in series with an MEA electrolyser or alkaline flow cell to produce multi-carbon products.
Figure 5:
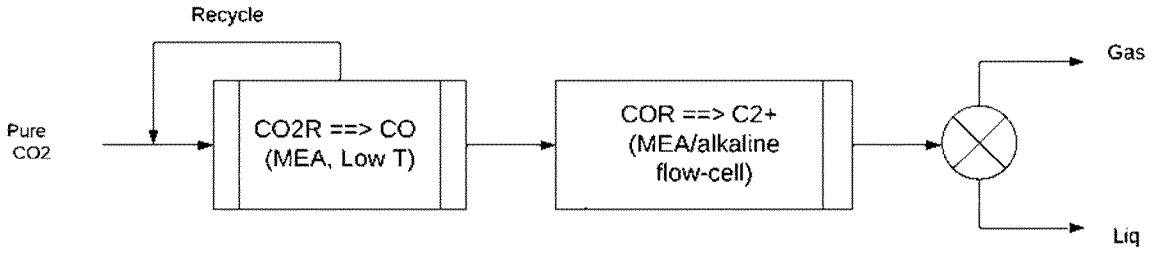
FIG. 5 is a schematic process flow diagram of a low temperature (i.e., below 100° C.) MEA electrolyser that is supplied with the pure gaseous $CO_2$ stream generated in the anodic side of the system of FIG. 3 to produce CO, in series with another MEA electrolyser or alkaline flow cell to produce multi-carbon products (COR products).
Figure 6:
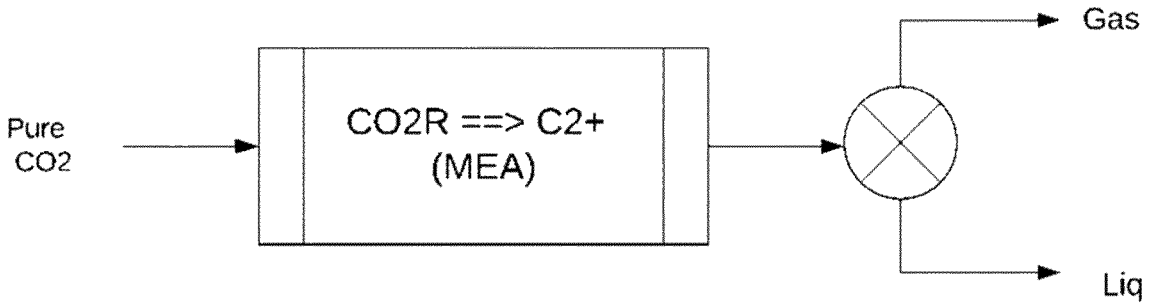
FIG. 6 is a schematized process flow diagram of a $CO_2$RR MEA electrolyser that is supplied with the pure gaseous $CO_2$ stream generated in the anodic side of the system of FIG. 3 to generate multi-carbon products at low-temperature (i.e., below 100° C.).

FIG. 3 illustrates the zero-gap $CO_2$RR-OOR electrolyser as encompassed herein which can be combined in an assembly with any known downstream electrolyser systems, as shown for example in FIGS. 4 to 6. FIG. 8 illustrates the recycling of the recovered crossover $CO_2$ to the same electrolyser as part of the $CO_2$-containing stream. These example configurations of electrolysers eliminate the need for a stream of pure gaseous $CO_2$ as the initial electrolyser feedstream to produce industrial chemicals which offers significant cost advantage (i.e., $CO_2$ capture cost is avoided) and improved overall carbon footprint and life-cycle energy efficiency of such chemicals.

FIG. 3 represents a conceptual design of $CO_2$-ORR operating GOR as an organic oxidation reaction which results in the generation of $H^+$ at the anode. A portion of $CO_2$ present in the gaseous $CO_2$-containing stream serving as a cathode feed stream can react electrochemically to produce $CO_2$RR products while the remaining fraction reacts with OH ions forming carbonate and bicarbonate ions. 50-70 vol % of $CO_2$ fed into the cathode based on the total volume of the gaseous $CO_2$ stream gets converted into carbonates/bicarbonates (see the study of Larrazábal G. O., et al., entitled "A comprehensive approach to investigate $CO_2$ reduction electrocatalysts at high current densities" (Acc. Mater. Res., 2021, 2, 220-229). The anion-exchange membrane (AEM) allows the transport of carbonate or bicarbonate ions to the anode where such ions can react with generated $H^+$ and regenerate the pure stream of $CO_2$.

Referring to the combination of electrolysers as shown in FIGS. 3 and 4, the assembly further includes in series a downstream SOEC (solid oxide electrolyser cell) and any COR electrolyser, such as an MEA (Membrane Electrode Assembly) or another alkaline flow cell (also referred to as a one-gap electrolyser). The process can include feeding the pure gaseous $CO_2$ stream, which was recovered from the anodic product mixture of the $CO_2$RR-OOR electrolyser to the SOEC to produce CO. The assembly can further include any carbon oxide reduction reaction (CORR) electrolyser, such as an MEA (Membrane Electrode Assembly) or another alkaline flow cell, to generate additional multi-carbon products and enhance $CO_2$ utilization. The SOEC can be operated at high temperature, for example at a temperature of at least 350° C. to produce the CO. For example, the SOEC can be operated at a temperature ranging between 350° C. and 800° C., between 400° C. and 800° C., between 450° C. and 800° C., or between 500° C. and 800° C.

Referring to the combination of electrolysers as shown in FIGS. 3 and 5, the assembly further includes in series a first MEA type electrolyser and any COR electrolyser, such as a second MEA or another alkaline flow cell. The process can include feeding the pure gaseous $CO_2$ stream, which was recovered from the anodic product mixture of the $CO_2$RR-OOR electrolyser to the MEA electrolyser to produce CO, and further feeding the CO to the second MEA/alkaline flow cell to generate multi-carbon products. The first MEA electrolyser is configured to be operated at a temperature below 100° C. to produce CO which can be utilized as the feed to any CO-electrolyser. For example, the first MEA electrolyser can be operated at a temperature between 0° C. and 100° C., between 0° C. and 90° C., between 0° C. and 80° C., or between 0° C. and 70° C.

Referring to the combination of electrolysers as shown in FIGS. 3 and 6, the assembly can further include an MEA-type electrolyser that is supplied with the pure gaseous $CO_2$ stream (crossover $CO_2$) produced from the $CO_2$RR-OOR electrolyser. The MEA-type electrolyser is configured to be operated at a temperature below 100° C. to produce products of electrochemical reductions such as $C_{2+}$ products. For example, the MEA-type electrolyser can be operated at a temperature between 0° C. and 100° C., between 0° C. and 90° C., between 0° C. and 80° C., or between 0° C. and 70° C.

Referring to FIG. 8, the assembly can include the zero-gap $CO_2$RR-OOR electrolyzer as described herein being an MEA electrolyzer. The process includes recovering the anodic product mixture from the anodic compartment, the anodic product mixture comprising the crossover $CO_2$; separating the crossover $CO_2$ from the anodic product mixture to produce the $CO_2$-depleted liquid stream and the recovered pure gaseous $CO_2$ stream. The process further includes redirecting the recovered pure gaseous $CO_2$ stream to the cathodic compartment of the MEA electrolyzer via a recycle line as a portion of the gaseous $CO_2$-containing stream to maximize $CO_2$ utilization. For example, the MEA electrolyzer can be operated at a temperature between 0° C. and 100° C., between 10° C. and 90° C., between 20° C. and 80° C., or between 30° C. and 70° C.

Figure 27:
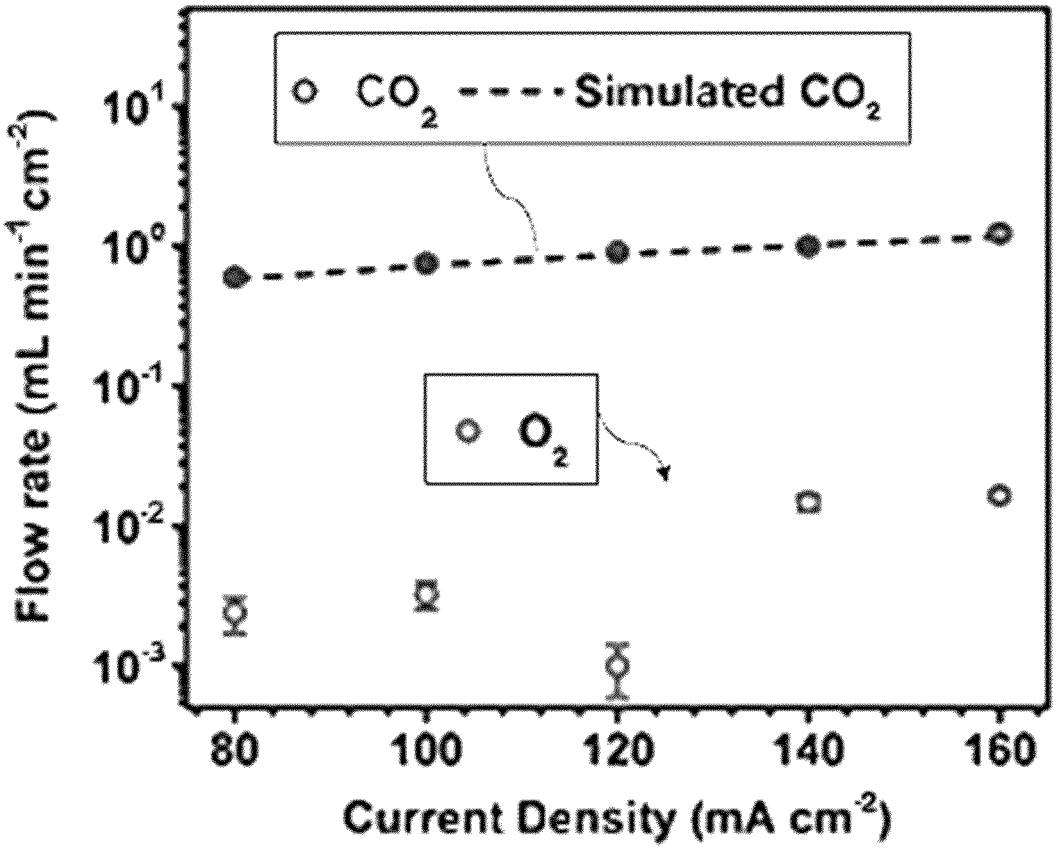
FIG. 27 illustrates the performance of the $CO_2$RR-GOR electrolysis system including copper cathode catalyst and anode platinum catalyst with the mass loading of Cu: 0.5 mg $cm^{-2}$ and Pt: 2 mg $cm^{-2}$, including the recovery rates and purities of $CO_2$ at the anodic product stream at various current densities and 50° C. Recovery rates are defined by dividing the $CO_2$ flow rate from measurement by that from prediction.
Figure 28:
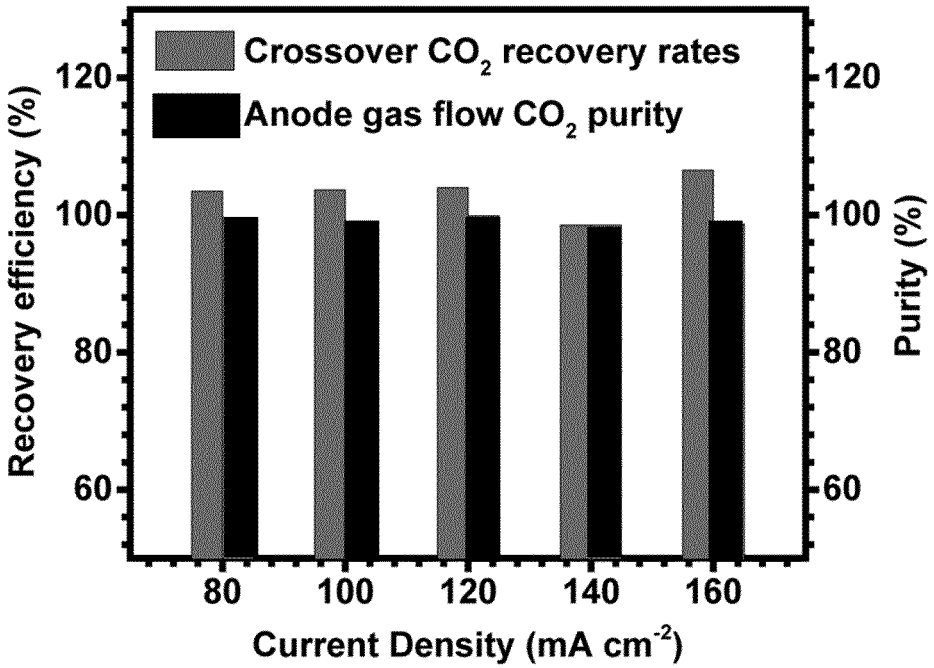
FIG. 28 illustrates the performance of the $CO_2$RR-GOR electrolysis system including copper cathode catalyst and anode platinum catalyst with the mass loading of Cu: 0.5 mg cm" 2 and Pt: 2 mg $cm^{-2}$, including the FE distributions of liquid products of GOR at various current densities at 50° C.
Figure 29:
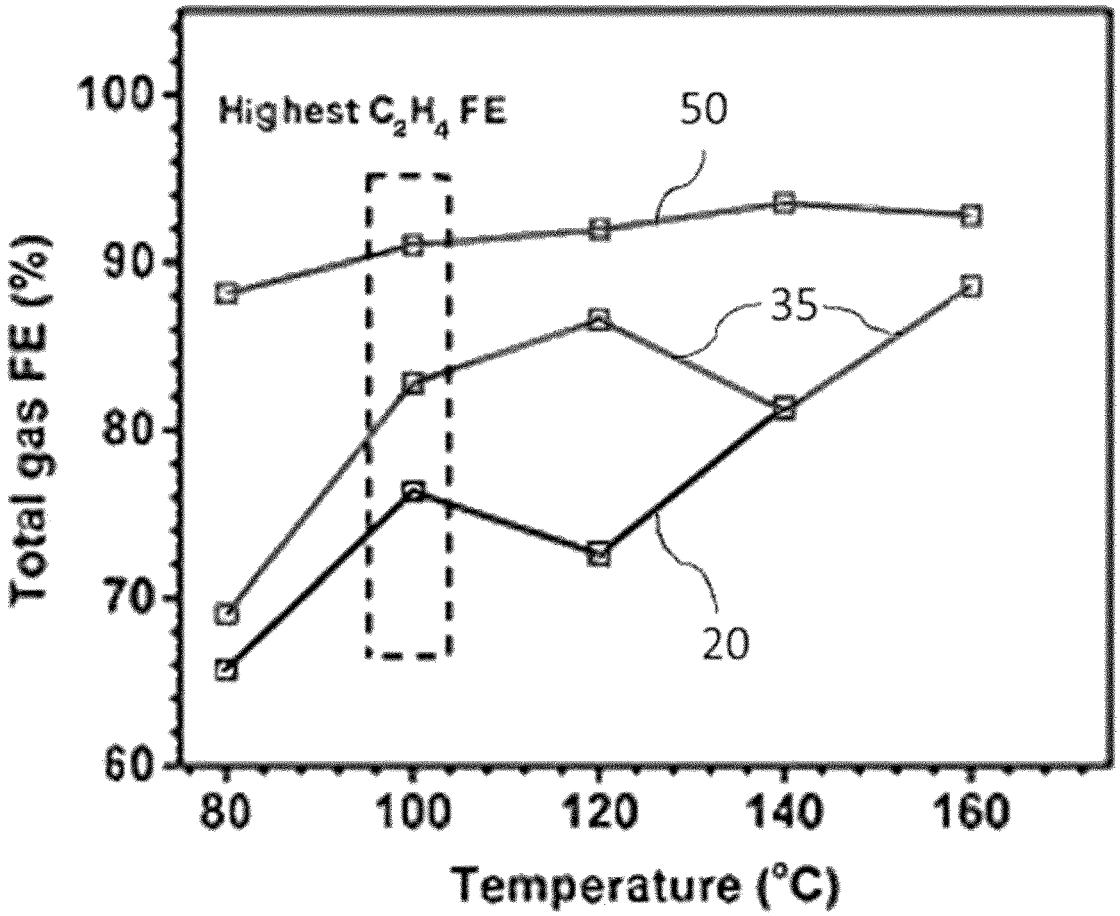
FIG. 29 illustrates the performance of the $CO_2$RR-GOR electrolysis system including copper cathode catalyst and anode platinum catalyst with the mass loading of Cu: 0.5 mg $cm^{-2}$ and Pt: 2 mg $cm^{-2}$, including the FE distributions of gas products of $CO_2$RR at various temperatures and current densities.

The present $CO_2$ recycling strategy requires a high $CO_2$ recovery rate (defined as the fraction of the recovered $CO_2$ flow rate to the rate of $CO_2$ crossover). Referring to the graph of FIG. 27, one can see that the amount of $CO_2$ collected at the anode is in agreement with the stoichiometry of OH generated and electrons transferred 16, indicating a $CO_2$ recovery rate approaching 100% (see FIG. 28). Additionally, the anodic $CO_2$ flow rate is three orders of magnitude larger than that of $O_2$ (see FIG. 27), indicating the anodic gas stream is at least 99% $CO_2$ (see FIG. 28). This low/absent level of $O_2$ enables direct recycling of this anode gas stream to the cathode, without the need for separation and associated energy costs. Experimental observations are in good agreement with the mass balance analysis provided in FIG. 7 and indicate the potential for high carbon efficiency without any energy penalty in zero-gap, neutral media $CO_2RR$ MEA electrolysers.

Suppressing $CO_2RR$ liquid products and subsequent crossover.

Ethylene production via $CO_2RR$ is accompanied by cathodic liquid-phase products such as ethanol, acetate and propanol, much of which can cross the AEM to join the anodic product mixture. Cathode-to-anode crossover of liquid products remains a challenge in $CO_2RR$ systems as this liquid products risk oxidation and dilution in the anolyte.

Figure 30:
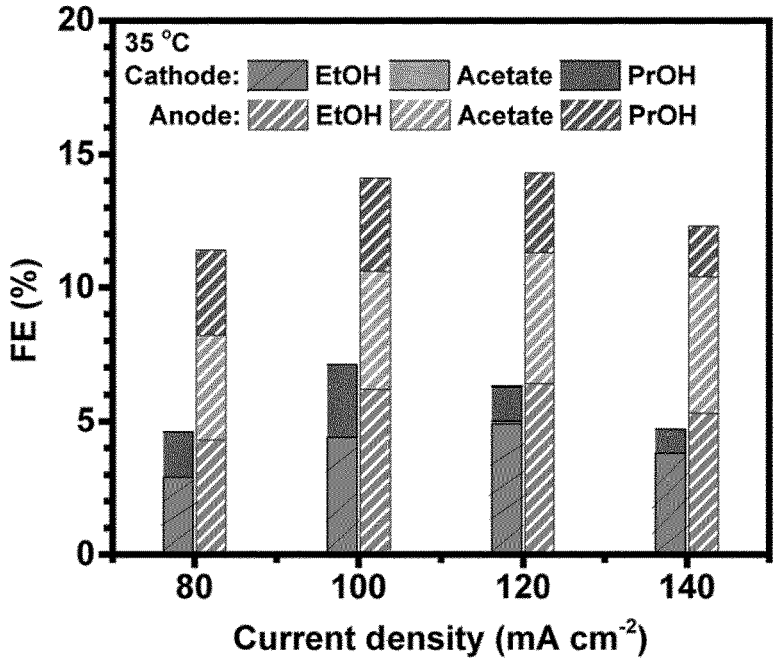
FIG. 30 illustrates the FE toward liquid product distributions in $CO_2$RR-GOR electrolyser in the cathodic (solid) and anodic (patterned) streams, showing FE (in %) at 35° C.
Figure 31:
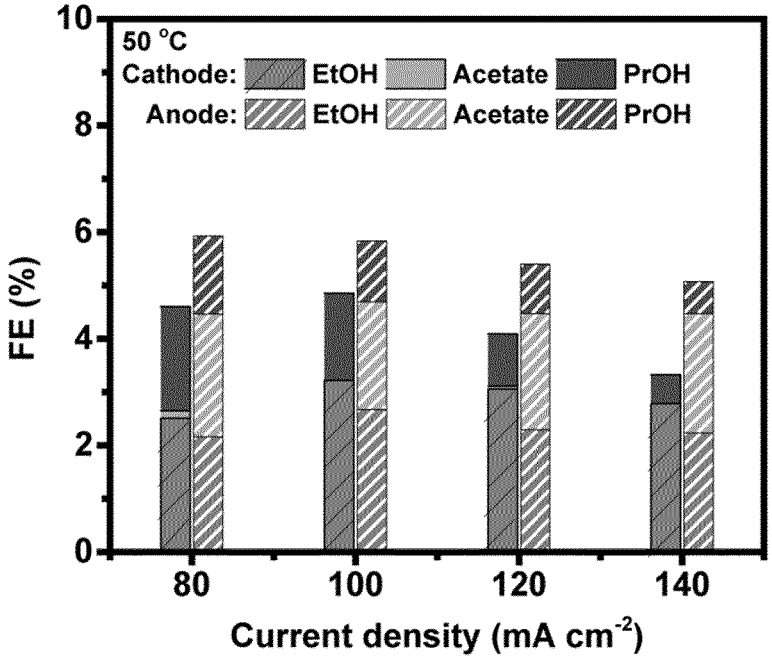
FIG. 31 illustrates the FE toward liquid product distributions in $CO_2$RR-GOR electrolyser in the cathodic (solid) and anodic (patterned) streams, showing FE (in %) at 50° C. At 50° C., only <6% FE of $CO_2$RR products crosses over to the anolyte for all the current densities studied.
Figure 32:
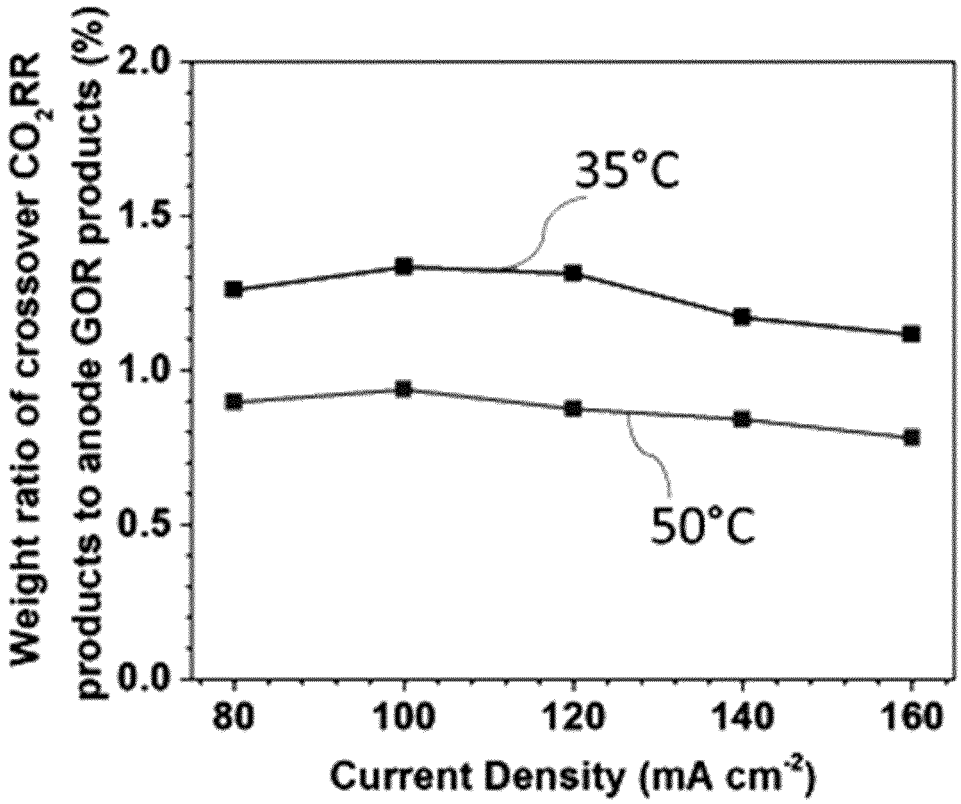
FIG. 32 is a graph showing a weight ratio between the liquid products of $CO_2$RR (ethanol, acetate and propanol) and the target products of GOR (gluconate, glucuronate and glucarate) at the temperature of 35° C. and 50° C.

In some implementations, adjusting the temperature of the electrolyser can control, e.g. reduce, the crossover of cathodic liquid products. Increasing the temperature from 20° C. to 50° C., the FEs toward the major gas products of $CO_2RR$ ($C_2H_4$ and CO) were found to be increased from 48% to 56% at a constant current density of 100 mA $cm^{-2}$ (see FIGS. 22, 23, 24 and 29), and the FE toward the liquid products of $CO_2RR$ was seen to decrease from 24% to 9%. Thus, in some implementations, adjusting the temperature can reduce the crossover of cathodic liquid products, such as ethanol and n-propanol (see FIGS. 30 and 31) to the anode side, attributable to a higher rate of evaporation into the cathode gas product stream. As a result, referring to FIG. 32, the weight ratio of the liquid $CO_2RR$ products to the GOR target products in the anolyte stream was <1% at 50° C., in contrast to 1.4% at 35° C. Thus, operating at modestly elevated temperatures, for example between 30° C. and 50° C., can benefit the $CO_2RR$-GOR system by reducing full-cell voltage and by suppressing the formation and crossover of liquid $CO_2RR$ products.

It should be understood that any one of the above-mentioned implementations of the $CO_2RR$-OOR system and related process may be combined with any other of the aspects thereof unless two aspects clearly cannot be combined due to their mutual exclusivity.

EXPERIMENTAL RESULTS

Materials

Potassium bicarbonate ($KHCO_3$, 99.7%), D-glucose (99.5%), copper nanoparticles (25 nm), Nafion™ 1100W (5 wt. % in a mixture of lower aliphatic alcohols and water) and Pt/C (40 wt. % Pt on Vulcan XC72) were purchased from Sigma Aldrich and used as received. Aquivion D79-25BS ionomer was purchased from Fuel Cell Store. Piperion (40 μm) was used as the anion-exchange membrane, purchased from W7Energy and stored in 0.5M KOH. The water used in this study was 18 MO Milli-Q deionized-(DI-)water.

Electrodes

For the $CO_2RR$, we prepared the gas diffusion electrodes (GDEs) by spray-depositing a catalyst ink dispersing 1 mg mL-1 of Cu nanoparticles and 0.25 mg mL-1 of Nafion™ 1100W in methanol onto a PTFE substrate that pre-sputtered with a 200 nm thick polycrystalline Cu layer. The Cu sputtering procedure was described in detail in the previous reports. The mass loading of Cu NPs on the GDE was tuned between 0.5 to 1.0 mg/$cm^2$. The GDEs were dried in the air overnight prior to experiments.

For the GOR anode electrodes, a commercially available Pt/C was first physically mixed with an ionomer (Aquivion D79-25BS) in a glass beaker and then sonicated for 1 h. The resulting catalyst ink was then spray-coated on both sides of the hydrophilic carbon cloth until the Pt loading of 0.5 to 2.0 mg $cm^{-2}$ was achieved.

Characterizations

Scanning Electron Microscopy

Scanning electron microscopy (SEM) images of the cathode and anode were captured by an FEI Quanta FEG 250 environmental SEM.

Transition Electron Microscopy

Transition electron microscopy (TEM) images and elemental mappings were acquired by an FEI Titan 80-300 kV TEM microscope.

X-Ray Photoelectron Spectra

X-ray photoelectron spectra (XPS) of the electrodes were determined by a model 5600, PerkinElmer using a monochromatic aluminum X-ray source.

$^1H$ Nuclear Magnetic Resonance

1H NMR spectra were determined by the Agilent DD2 500 spectrometer.

High-Performance Liquid Chromatography (HPCL)

The by-products of the GOR were measured by high-performance liquid chromatography (UltiMate 3000 HPLC) equipped with an Aminex HPX-87H column (Bio-Rad) and a reflective index detector. The eluent was 0.05 M $H_2SO_4$, and the column was kept at 60° C.

Assembling of the $CO_2RR$-GOR System

The MEA set (5 $cm^{-2}$) was purchased from Dioxide Materials. A cathode was cut into a 2.5 cm×2.5 cm piece and placed onto the MEA cathode plate with a flow window with a dimension of 2.23 cm×2.23 cm. The four edges of the cathode were sealed by copper tapes and then Kapton tapes, and make sure the tapes did not cover the flow window. A Piperion AEM (3 cm×3 cm) was carefully placed onto the cathode. A gasket with a 2.23 cm×2.23 cm window was placed on the cathode. The Pt/C loaded carbon cloth anode (2 cm×2 cm) was placed onto the AEM.

Electrochemical Measurements

The cathode side of the MEA was fed with $CO_2$ flow (0.18 to 10 sccm per $cm^2$ of electrode area, 10 sccm $cm^{-2}$ if not specified) that comes from both $CO_2$ feedstock and anodic gas stream. The anode side was circulated with a solution containing 1M $KHCO_3$ and glucose with various active organic concentrations (0 to 2M) at 10 mL/min by a peristaltic pump. A gas-tight glass bottle with four in/out channels (gas inlet, gas outlet, liquid inlet and liquid outlet) was used as the anolyte reservoir and gas-liquid separator. In typical $CO_2RR$-GOR performance evaluations, the gas inlet channel was sealed, and the gas outlet channel was connected to a 'Y' shape tubing connector.

Since the anolyte reservoir/gas-liquid separator is gas tight, the $CO_2$ pressure between the feedstock stream and the anodic stream will eventually balance and promote a steady flow rate from both sides. The electrochemical measurements were performed with a potentiostat (Autolab PGSTAT204 with 10A booster). All the performance metrics were recorded after at least 1000 seconds of stabilization at a specific condition. The full-cell voltages reported in this work are not iR corrected.

Product Analysis

The $CO_2RR$ gas products, oxygen, and $CO_2$ were analyzed by injecting the gas samples into a gas chromatograph (Perkin Elmer *Clarus* 590) coupled with a thermal conductivity detector (TCD) and a flame ionization detector (FID). The gas chromatograph was equipped with a Molecular Sieve 5A Capillary Column and a packed Carboxen-1000 Column with argon as the carrier gas. The volumetric gas flow rates in and out of the cell were measured with a bubble column. The FE of a gas product is calculated as follows:

$$FE_i = x_i \times \frac{VP}{RT} \times \frac{n_i F}{J}$$

Where $x_i$ is the volume fraction of the gas product i, V is the outlet gas flow rate in L $s^{-1}$, P is atmosphere pressure 101.325 kPa, R is the ideal gas constant 8.314 J $mol^{-1}$ $K^{-1}$, T is the room temperature in K, n; is the number of electrons required to produce one molecule of product F is the Faraday Constant 96485 C $mol^{-1}$, and J is the total current in A. To analyze the anodic gas stream component, the gas outlet channel of the anolyte reservoir was disconnected from the tubing for circulating to the cathode. A 20 sccm argon flow was input from the 'gas inlet' channel of the anolyte reservoir as the carrier gas to promote the accurate analysis of $CO_2$ and $O_2$ components in the anode gas.

The liquid products from the cathode side of the SC-MEA were collected using a cold trap cooled to 0° C. The collected liquid from the cathode side and the anolyte were quantified separately by the proton nuclear magnetic resonance spectroscopy (1H NMR) on an Agilent DD2 500 spectrometer in D20 using water suppression mode and dimethyl sulfoxide (DMSO) as the internal standard. Typical 1H NMR spectra can be found in FIGS. 12 and 13. For each plot of liquid product quantification, fresh anolyte was used, and the duration of the collection is 30 minutes. The FE of a liquid product is calculated as follows:

$$FE_i = m_i \times \frac{n_i F}{Jt}$$

Where $m_i$ is the quantity of the liquid product i in mole, t is the duration of product collection (1800 seconds).

$CO_2$RR-GOR System Performance

When run at 100 mA $cm^{-2}$ and 50° C., the $CO_2$RR-GOR system provides a full-cell voltage of 1.80±0.1 V, representing a 1.6 V lower voltage than the conventional $CO_2$RR-OER system at the same current density and temperature. This low full-cell voltage can be attributed to the lower thermodynamic potential of GOR than OER (0.05 vs. 1.23 V) and the anodic catalyst's high activity toward GOR. Such a low full-cell potential significantly reduces electricity demand (Table 1). At 100 mA $cm^{-2}$, the system delivers ethylene FEs of 42%, 48%, and 44% at 20° C., 35° C., and 50° C. (see FIGS. 22 to 24 and tables 2 and 3).

TABLE 1 (1/2)

Energy assessment comparison between the state-of-art $CO_2$-to-ethylene $CO_2$RR devices.

| Metrics | Neutral-MEA [a] | Acidic flow cell [a] | Acidic MEA[a] | This work (max carbon efficiency) |
|---|---|---|---|---|
| Reaction pair | $CO_2$R-OER | $CO_2$R-OER | $CO_2$R-OER | $CO_2$R-GOR |
| Cell type | MEA | Flow cell | MEA | MEA |
| Electrolyte | Neutral | Acidic | Acidic | Neutral |
| Full-cell voltage (V) | 3.75 | 4.20 | 3.80 | 1.90 |
| Ethylene FE (%) | 45 | 28 | 34 | 26 |
| Anode $O_2$ FE (%) | 100 | 100 | 100 | — |
| Anode GOR FE (%) | 0 | 0 | 0 | — |
| Current density (mA $cm^{-2}$) | 120 | 1200 | 100 | 100 |

TABLE 1 (1/2)-continued

Energy assessment comparison between the state-of-art $CO_2$-to-ethylene $CO_2$RR devices.

| Metrics | Neutral-MEA [a] | Acidic flow cell [a] | Acidic MEA[a] | This work (max carbon efficiency) |
|---|---|---|---|---|
| Input $CO_2$ flow rate (sccm $cm^{-2}$) | 10 | 3 | 0.8 | 0.18 |
| $CO_2$ carbon efficiency (%) | 3.6 | 78 | 31 | 78 |
| $CO_2$-to-ethylene carbon efficiency (%) | 1.2 | 28.4 | 10.5 | 36 |
| Demonstrated stability (Hours) | 100 [b] | 14 [c] | 8 [d] | — |
| Energy distributions (GJ per ton ethylene) | | | | |
| Electrolyser electricity | 345 | 620 | 462 | 302 |
| Cathode gas separation | 38 | 17 | 23 | 17 |
| Anode gas separation | 71 | 0 | 0 | 0 |
| Overall energy | 499 | 637 | 485 | 319 |

[a] All the data sets from references are the ones that consume the least overall energy for producing one ton of ethylene.

[b] Recorded with the $CO_2$ carbon efficiency indicated in the same column above.

[c] Recorded with a $CO_2$ carbon efficiency of 20%.

[d] Recorded with a $CO_2$ carbon efficiency of 1.8%.

[e] The sum of the GOR product FEs obtained from NMR (FIG. 37) and HPLC

TABLE 1 (2/2)

Energy assessment comparison between the state-of-art $CO_2$-to-ethylene $CO_2$RR devices

| Metrics | This work (max FE) | This work (min energy) |
|---|---|---|
| Reaction pair | $CO_2$R-GOR | $CO_2$R-GOR |
| Cell type | MEA | MEA |
| Electrolyte | Neutral | Neutral |
| Full-cell voltage (V) | 1.80 | 1.90 |
| Ethylene FE (%) | 45 | 32 |
| Anode $O_2$ FE (%) | 0.6 | — |
| Anode GOR FE (%) | 94[e] | — |
| Current density (mA $cm^{-2}$) | 100 | 100 |
| Input $CO_2$ flow rate (sccm $cm^{-2}$) | 10 | 0.36 |
| $CO_2$ carbon efficiency (%) | N/A | 48 |
| $CO_2$-to-ethylene carbon efficiency (%) | 1.1 | 23 |
| Demonstrated stability (Hours) | — | 80 [b] |
| Energy distributions (GJ per ton ethylene) | | |
| Electrolyser electricity | 165 | 246 |
| Cathode gas separation | 147 | 16 |
| Anode gas separation | 0 | 0 |
| Overall energy | 312 | 262 |

[b] Recorded with the $CO_2$ carbon efficiency indicated in the same column above.

[e] The sum of the GOR product FEs obtained from NMR (FIG. 37) and HPLC

TABLE 2

The $CO_2RR$ product distribution of the copper-based catalyst in the MEA at various current densities at 35° C.

| Current density (mA cm$^{-2}$) | Cell voltage (V) | Faradaic efficiency (%) | | | | | | | $J_{ethylene}$ (mA cm$^{-2}$) | $J_{CO2RR}$ (mA cm$^{-2}$) |
|---|---|---|---|---|---|---|---|---|---|---|
| | | $C_2H_4$ | EtOH | n-PrOH | Acetate | CO | $CH_4$ | $H_2$ | | |
| 80 | 2.00 ± 0.05 | 42.1 | 7.2 | 4.9 | 3.9 | 2.9 | <0.1 | 24.1 | 33.7 | 48.8 |
| 100 | 2.21 ± 0.06 | 48.0 | 10.6 | 6.2 | 4.4 | 1.9 | <0.1 | 33.0 | 48.0 | 71.1 |
| 120 | 2.30 ± 0.04 | 41.8 | 11.3 | 4.3 | 5.0 | 1.4 | <0.1 | 43.4 | 50.2 | 76.6 |
| 140 | 2.43 ± 0.06 | 33.3 | 9.1 | 2.8 | 5.1 | 1.4 | <0.1 | 46.4 | 46.7 | 72.5 |
| 160 | 2.55 ± 0.03 | 26.9 | 8.9 | 2.6 | 4.1 | 1.1 | <0.1 | 60.6 | 43.0 | 69.7 |

MEA operating conditions: anolyte: 1M $KHCO_3$ + 1M glucose; anolyte flow rate: 20 mL/min; $CO_2$ inlet flow rate: 10 sccm cm$^{-2}$; cell temperature: 35° C.; and cell pressure: atmospheric pressure.

TABLE 3

The $CO_2RR$ product distribution of the copper-based catalyst in the MEA at various current densities at 50° C.

| Current density (mA cm$^{-2}$) | Cell voltage (V) | Faradaic efficiency (%) | | | | | | | $J_{ethylene}$ (mA cm$^{-2}$) | $J_{CO2RR}$ (mA cm$^{-2}$) |
|---|---|---|---|---|---|---|---|---|---|---|
| | | $C_2H_4$ | EtOH | n-PrOH | Acetate | CO | $CH_4$ | $H_2$ | | |
| 80 | 1.76 ± 0.02 | 33.9 | 4.7 | 3.4 | 2.4 | 8.3 | <0.1 | 33.9 | 27.1 | 43.2 |
| 100 | 1.81 ± 0.04 | 43.5 | 5.9 | 2.8 | 2.0 | 12.0 | <0.1 | 43.5 | 43.5 | 64.5 |
| 120 | 2.08 ± 0.02 | 41.0 | 5.3 | 1.9 | 2.2 | 11.1 | <0.1 | 41.0 | 49.2 | 72.2 |
| 140 | 2.26 ± 0.04 | 38.6 | 5.0 | 1.1 | 2.2 | 6.6 | <0.1 | 38.6 | 54.1 | 72.4 |
| 160 | 2.40 ± 0.03 | 34.1 | 4.7 | 1.0 | 2.0 | 3.9 | <0.1 | 34.1 | 54.6 | 72.4 |

MEA operating conditions: anolyte: 1M $KHCO_3$ + 1M glucose; anolyte flow rate: 20 mL/min; $CO_2$ inlet flow rate: 10 sccm cm$^{-2}$; cell temperature: 50° C.; and cell pressure: atmospheric pressure.

Figure 25:
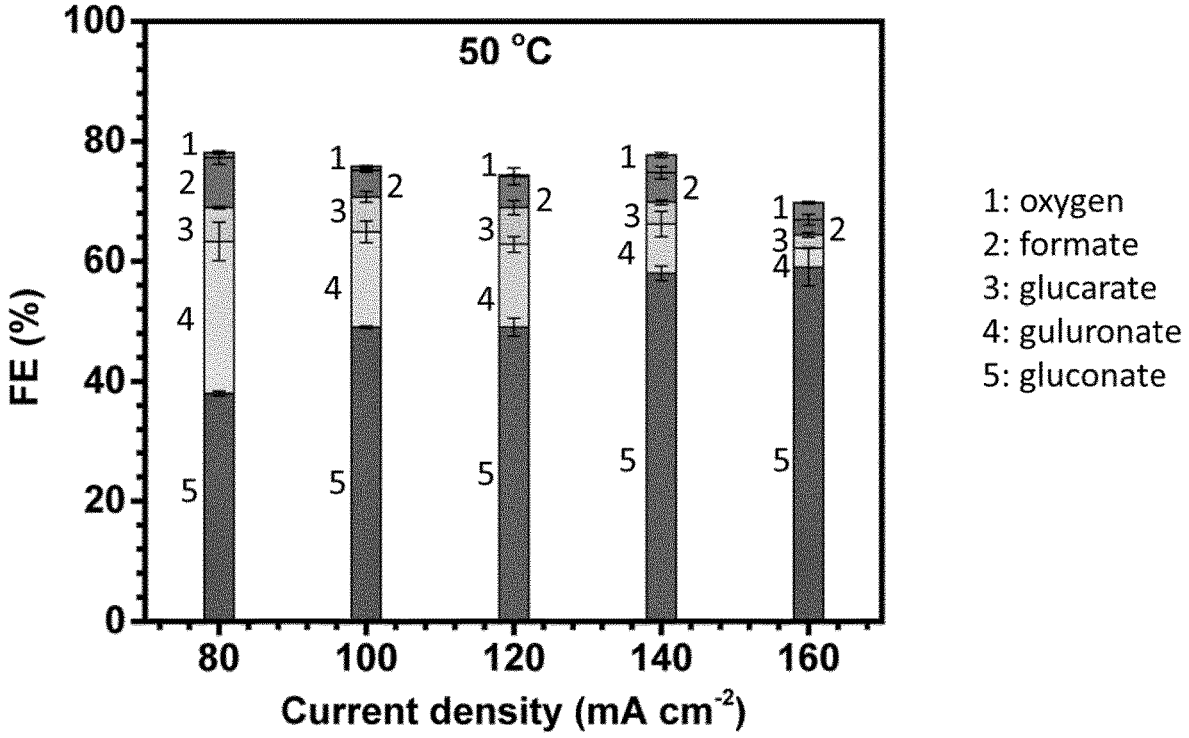
FIG. 25 illustrates the performance of the $CO_2$RR-GOR electrolysis system including copper cathode catalyst and anode platinum catalyst with the mass loading of Cu: 0.5 mg $cm^{-2}$ and Pt: 2 mg $cm^{-2}$, including the $CO_2$ and $O_2$ flow rates (normalized by electrode geometric area) in the anodic gas streams at 50° C. The simulated $CO_2$ is assessed by the stoichiometry of generated $OH^-$ and transferred electrons, assuming $CO_2$ is converted to $CO_3^{2-}$.

In addition, the selectivity of the GOR was investigated for a wide range of current densities (from 80 mA cm$^{-2}$ to 160 mA cm$^{-2}$) and operating temperatures (see FIG. 25, tables 4 and 5).

TABLE 4

The glucose oxidation reaction (GOR) product distribution of the Pt—C catalyst in the MEA at various current densities and 35° C.

| Current density (mA cm$^{-2}$) | Cell voltage (V) | Faradaic efficiency (%) | | | | | $J_{gluconate}$ (mA cm$^{-2}$) |
|---|---|---|---|---|---|---|---|
| | | Gluconate | Formate | Glucarate | Glucuronate | Total | |
| 80 | 2.00 ± 0.05 | 34.2 | 6.8 | 6.1 | 18.7 | 65.8 | 27.4 |
| 100 | 2.21 ± 0.06 | 43.6 | 3.9 | 5.4 | 13.6 | 66.5 | 43.6 |
| 120 | 2.30 ± 0.04 | 48.1 | 3.2 | 4.8 | 11.2 | 67.3 | 57.7 |
| 140 | 2.43 ± 0.06 | 51.4 | 2.5 | 3.9 | 7.4 | 65.2 | 72.0 |
| 160 | 2.55 ± 0.03 | 46.7 | 2.4 | 2.7 | 4.3 | 56.1 | 74.7 |

MEA operating conditions: anolyte: 1M $KHCO_3$ + 1M glucose; anolyte flow rate: 20 mL/min; cell temperature: 35° C.; and cell pressure: atmospheric pressure.

TABLE 5

The glucose oxidation reaction (GOR) product distribution of the Pt—C catalyst in the MEA at various current densities.

| Current density (mA cm$^{-2}$) | Cell voltage (V) | Faradaic efficiency (%) | | | | | $J_{gluconate}$ (mA cm$^{-2}$) |
|---|---|---|---|---|---|---|---|
| | | Gluconate | Formate | Glucarate | Glucuronate | Total | |
| 80 | 1.76 ± 0.02 | 37.1 | 7.3 | 5.7 | 21.2 | 71.3 | 37.1 |
| 100 | 1.81 ± 0.04 | 48.6 | 4.7 | 4.9 | 15.9 | 74.1 | 48.6 |
| 120 | 2.08 ± 0.02 | 52.3 | 3.9 | 5.0 | 12.7 | 73.9 | 62.8 |

TABLE 5-continued

The glucose oxidation reaction (GOR) product distribution of the Pt—C catalyst in the MEA at various current densities.

| Current density | Cell voltage | Faradaic efficiency (%) | | | | | $J_{gluconate}$ |
|---|---|---|---|---|---|---|---|
| (mA $cm^{-2}$) | (V) | Gluconate | Formate | Glucarate | Glucuronate | Total | (mA $cm^{-2}$) |
| 140 | 2.26 ± 0.04 | 56.3 | 3.3 | 3.8 | 6.2 | 69.6 | 78.8 |
| 160 | 2.40 ± 0.03 | 56.2 | 3.0 | 2.1 | 3.5 | 64.8 | 89.9 |

MEA operating conditions: anolyte: 1M $KHCO_3$ + 1M glucose; anolyte flow rate: 20 mL/min; cell temperature: 50° C.; and cell pressure: atmospheric pressure.

Figure 26:
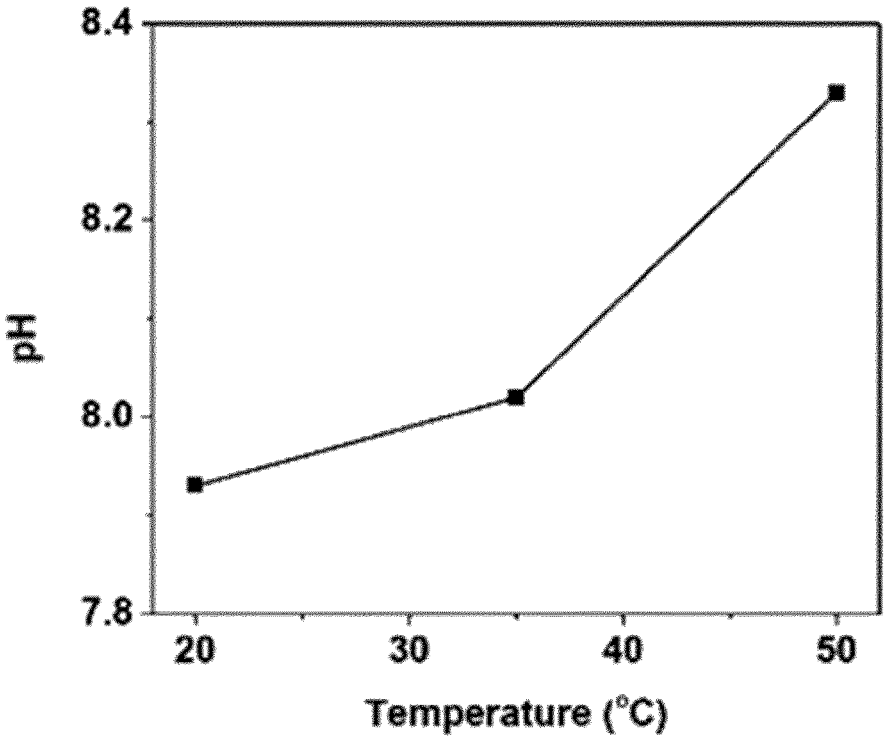
FIG. 26 is a graph showing the anolyte pH as a function of operating temperature. The anolyte contains 1 M $KHCO_3$ and 1 M glucose.

With the temperature increasing from 20° C. to 50° C., we detected a slight increase in anolyte pH (from pH 7.9 to 8.3, FIG. 26), attributable to the lower solubility of $CO_2$ in warmer anolyte. Gluconate was detected as the major GOR product (>49% FE), achieving a plateau of 56% at 140 mA $cm^{-2}$. The FEs toward oxygen remained <3% at current densities from 80 mA $cm^{-2}$ and 160 mA $cm^{-2}$ (<1% at 100 mA $cm^{-2}$ and a full-cell voltage of 1.80 V) owing to the sluggish kinetics of OER (see FIG. 15).

Carbon efficiency upper limits in the proposed $CO_2$RR-OOR system were studied. A common approach to determine carbon efficiency upper limits is restricting the $CO_2$ availability at the cathodic stream and measuring a ratio between [$CO_2$ converted to products] and [total $CO_2$ feeding].

Figure 33:
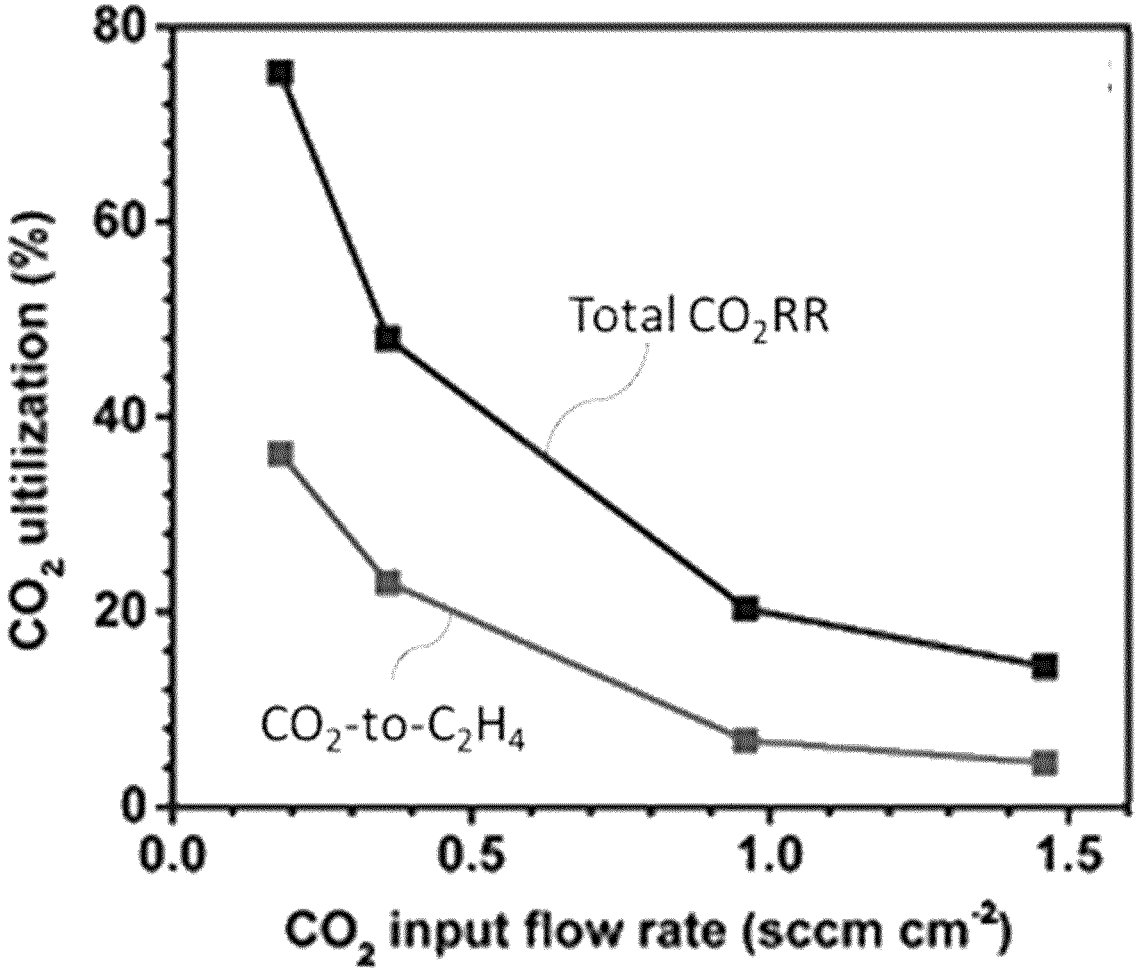
FIG. 33 illustrates the performance of the $CO_2$RR-GOR system under low $CO_2$ availability. The mass loadings on the cathode and anode electrodes are Cu: 0.5 mg $cm^{-2}$ and Pt: 2 mg $cm^{-2}$, including the $CO_2$ carbon efficiency for total $CO_2$RR and $CO_2$-to-$C_2H_4$ (mole ratio of the input $CO_2$ converted to $C_2H_4$) at various $CO_2$ input flow rates. The experiments are performed at a current density of 100 mA $cm^{-2}$. The flow rate of the $CO_2$ supplied is normalized by the geometric area of the electrodes.

Decreasing an input $CO_2$ flow rate increases the carbon efficiency (see Table 6 and FIG. 33).

TABLE 6

The $CO_2$RR product distribution of the copper-based catalyst in the MEA at 100 mA $cm^{-2}$ at various $CO_2$ flow rates.

| $CO_2$ flow rate (sccm $cm^{-2}$) | Cell voltage (V) | Faradaic efficiency (%) | | | | | | | Carbon efficiency | $CO_2$-to-$C_2H_4$ conversion |
|---|---|---|---|---|---|---|---|---|---|---|
| | | $C_2H_4$ | EtOH | n-PrOH | Acetate | CO | $CH_4$ | $H_2$ | | |
| 0.18 | 1.9 ± 0.1 | 25.7 | 5.8 | 1.1 | 1.3 | 5.1 | 4.8 | 46.1 | 75.3 | 36.2 |
| 0.36 | 1.9 ± 0.1 | 32.2 | 8.4 | 1.1 | 3.5 | 7.1 | 3.4 | 42.2 | 48.5 | 23.0 |
| 0.96 | 1.9 ± 0.1 | 36.3 | 10.4 | 1.9 | 1.6 | 8.1 | 2.3 | 37.6 | 20.3 | 6.8 |
| 1.46 | 1.9 ± 0.1 | 39.4 | 10.9 | 1.8 | 1.6 | 9.3 | 1.5 | 33.2 | 14.4 | 4.5 |

MEA operating conditions: anolyte: 1M $KHCO_3$ + 1M glucose; anolyte flow rate: 20 mL/min; cell temperature: 50° C.; and cell pressure: atmospheric pressure.

At an inlet $CO_2$ flow rate of 0.18 sccm $cm^{-2}$ (flow rates are normalized by electrode area), the system delivered a total $C_{2+}$ FE of ~44% at a constant current density of 100 mA $cm^{-2}$ and a full-cell voltage of 1.90 V, corresponding to a carbon efficiency of 75% toward all $CO_2$RR products (total carbon efficiency, see FIGS. 33 and 34), exceeding a typical upper limit of carbon efficiency in neutral media $CO_2$RR electrolysers. At these conditions the ethylene FE stabilizes at ~26%, corresponding to a $CO_2$-to-ethylene carbon efficiency of ~36% (FIG. 33). This carbon efficiency is 1.4-fold greater than the theoretical upper limit of 25% in $CO_2$-to-ethylene conversion in conventional, neutral-media, AEM-based electrolysers. Restricting the flow rate results in a significant increase in the hydrogen FE (FIG. 34), which can be attributed to the mass transfer limitation of $CO_2$. At the anode, GOR can maintain consistent selectivity and productivity, independent from $CO_2$ availability in the cathodic gas stream (see FIG. 34 and Table 7).

TABLE 7

The glucose oxidation reaction (GOR) product distribution of the Pt—C catalyst in the MEA at 100 mA $cm^{-2}$ at various $CO_2$ flow rates.

| $CO_2$ flow rate | Cell voltage | Faradaic efficiency (%) | | | | | $J_{gluconate}$ |
|---|---|---|---|---|---|---|---|
| (sccm $cm^{-2}$) | (V) | Gluconate | Formate | Glucarate | Glucuronate | Total | (mA $cm^{-2}$) |
| 0.18 | 1.9 ± 0.1 | 57.6 | 6.6 | 6.5 | 15.6 | 86.3 | 57.6 |
| 0.36 | 1.9 ± 0.1 | 52.9 | 7.1 | 6.3 | 13.1 | 80.8 | 52.9 |

TABLE 7-continued

The glucose oxidation reaction (GOR) product distribution of the Pt—C catalyst in the MEA at 100 mA $cm^{-2}$ at various $CO_2$ flow rates.

| $CO_2$ flow rate | Cell voltage | Faradaic efficiency (%) | | | | | $J_{gluconate}$ |
|---|---|---|---|---|---|---|---|
| (sccm $cm^{-2}$) | (V) | Gluconate | Formate | Glucarate | Glucuronate | Total | (mA $cm^{-2}$) |
| 0.96 | 1.9 ± 0.1 | 55.0 | 5.9 | 5.8 | 12.7 | 79.4 | 55.0 |
| 1.46 | 1.9 ± 0.1 | 56.9 | 6.0 | 5.9 | 14.4 | 83.2 | 56.9 |

MEA operating conditions: anolyte: 1M $KHCO_3$ + 1M glucose; anolyte flow rate: 20 mL/min; cell temperature: 50° C.; and cell pressure: atmospheric pressure.

Figure 34:
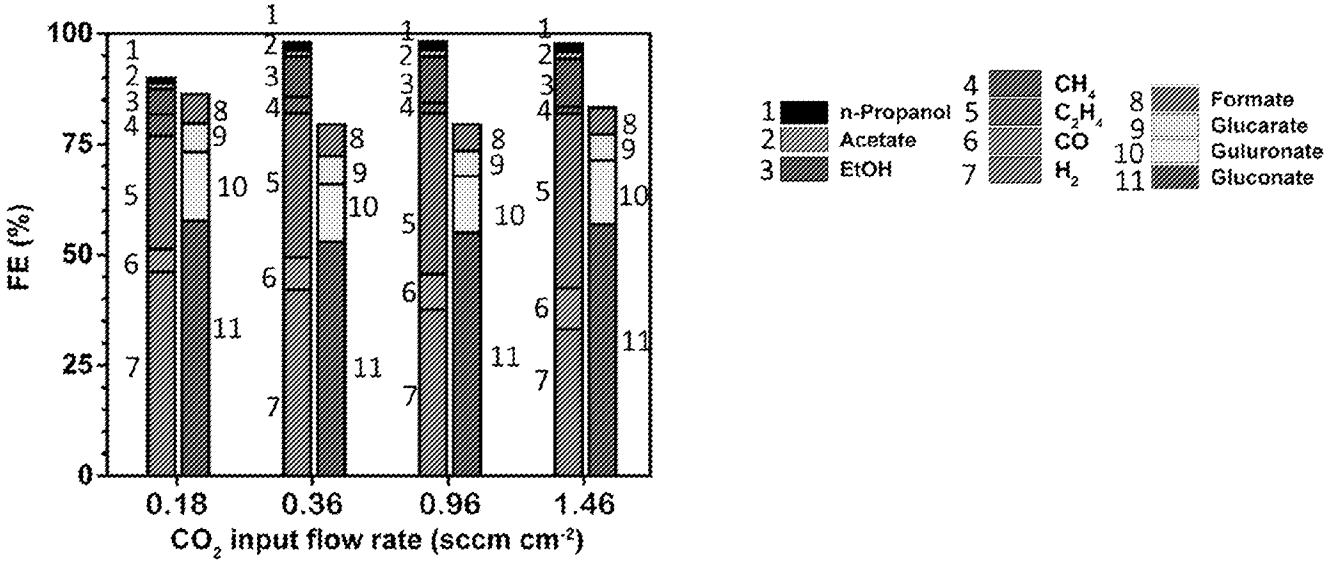
FIG. 34 illustrates the performance of the $CO_2$RR-GOR system under low $CO_2$ availability. The mass loadings on the cathode and anode electrodes are Cu: 0.5 mg $cm^{-2}$ and Pt: 2 mg $cm^{-2}$, including the FE distributions at various $CO_2$ input flow rates. The experiments are performed at a current density of 100 mA $cm^{-2}$. The flow rate of the $CO_2$ supplied is normalized by the geometric area of the electrodes.

A trade-off between carbon efficiency and ethylene FE is typical of $CO_2$-to-ethylene electrolysis (FIGS. 33 and 34). A higher carbon efficiency can reduce the energy demand for cathode separation, but the accompanying decrease in ethylene FE increases the specific electrolyser energy demand.

To reconcile these metrics, the total input energy (electricity, cathode separation and anode separation per ton of ethylene produced) of various $CO_2$RR approaches can be assessed, based on a previously established model (see Experimental Results section). The present $CO_2$RR-GOR system was assessed to achieve the lowest energy consumption of 259 GJ per ton of ethylene, with the input $CO_2$ flow rate being 0.36 sccm $cm^{-2}$, and the total carbon efficiency being 48% toward all $CO_2$RR products. The FE toward $C_{2+}$ and ethylene were shown to be 45% and 32%, respectively (Table 1).

Figure 2:
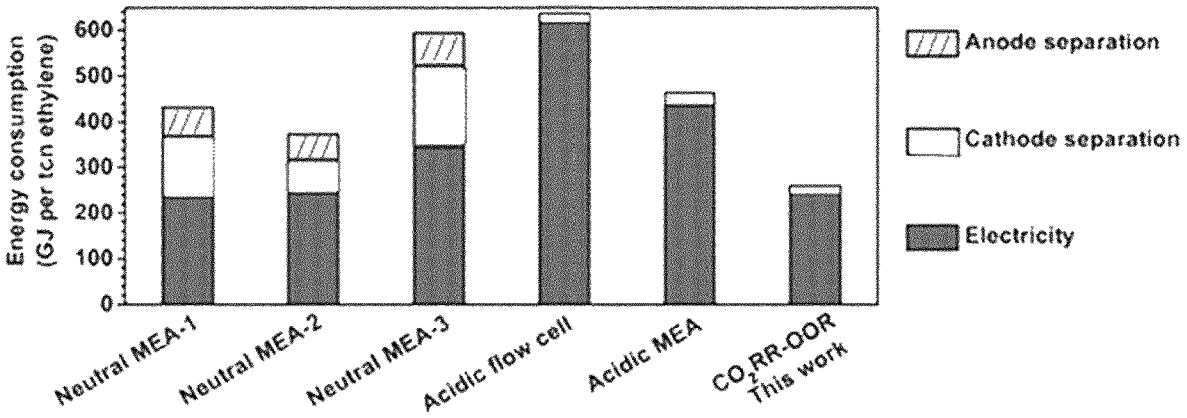
FIG. 2 illustrates the performance of an all-liquid anode enabling $CO_2$ recycling and low energy intensity for producing ethylene, including the energy intensity of ethylene production in benchmark systems from literature (Neutral MEA-1[5], -2[6], -3[4]; acidic flow cell[14]; acidic MEA[21]) versus this work.

Compared to state-of-art conventional $CO_2$-to-ethylene systems (i.e., MEAs based on AEM and neutral electrolyte), the present $CO_2$RR-GOR system eliminates the anodic separation energy (>57 GJ per ton ethylene, see FIG. 2, Table 1). When run under restricted $CO_2$ availability (0.36 sccm $cm^{-2}$), the $CO_2$RR-GOR system can further save about 57 GJ for cathodic separation per ton of ethylene produced. The overall energy intensity of ethylene production is ~30% less than the most energy-efficient prior $CO_2$RR systems among neutral and acidic $CO_2$-to-ethylene electrolysers (Table 1).

Stability with High Carbon Efficiency

Stability is a prerequisite for the industrial application of $CO_2$RR. However, long-term operation of $CO_2$RR with a high carbon efficiency (e.g., $CO_2$ carbon efficiency >40%) has not been achieved to date. The best $CO_2$ carbon efficiency achieved for a run duration of 100 hours was <4%.

Extended $CO_2$RR operation was performed under conditions that enable the lowest energy intensity of ethylene production. The $CO_2$RR-GOR system achieved stable electrosynthesis of cathodic $C_{2+}$ and anodic products for over 80 hours at a current density of 100 mA $cm^{-2}$, comparable to the stability of conventional MEAs. The system maintained an average full-cell voltage of 1.90±0.1 V, an average total $C_{2+}$FE of 42%, and an average carbon efficiency of about 45% toward all $CO_2$RR products (see FIG. 35 and Table 8).

TABLE 8

The $CO_2$RR product distribution of the copper-based catalyst in the MEA during extended operation.

| Time (hour) | $C_2H_4$ | EtOH | n-PrOH | Acetate | CO | $CH_4$ | $H_2$ | $J_{ethylene}$ (mA $cm^{-2}$) | $J_{CO2RR}$ (mA $cm^{-2}$) | Carbon efficiency (%) |
|---|---|---|---|---|---|---|---|---|---|---|
| | Faradaic efficiency (%) | | | | | | | | | |
| 15 | 32.2 | 8.4 | 1.1 | 3.5 | 7.1 | 3.4 | 42.2 | 32.2 | 55.7 | 48.0 |
| 28 | 32.7 | 9.1 | 1.2 | 1.9 | 6.7 | 3.6 | 42.9 | 32.7 | 55.2 | 46.4 |
| 42 | 31.3 | 9.4 | 1.1 | 2.5 | 6.1 | 3.8 | 43.6 | 31.3 | 54.2 | 44.9 |
| 56 | 30.8 | 8.6 | 1.0 | 1.8 | 5.8 | 4.1 | 44.1 | 30.8 | 52.1 | 42.6 |
| 71 | 30.1 | 9.1 | 0.9 | 1.6 | 5.6 | 4.4 | 44.5 | 30.1 | 51.7 | 41.7 |

MEA operating conditions: anolyte: 1M $KHCO_3$ + 1M glucose; anolyte flow rate: 20 mL/min; cell temperature: 50° C.; $CO_2$ inlet flow rate: 0.36 sccm $cm^{-2}$; and cell pressure: atmospheric pressure.

Figure 35:
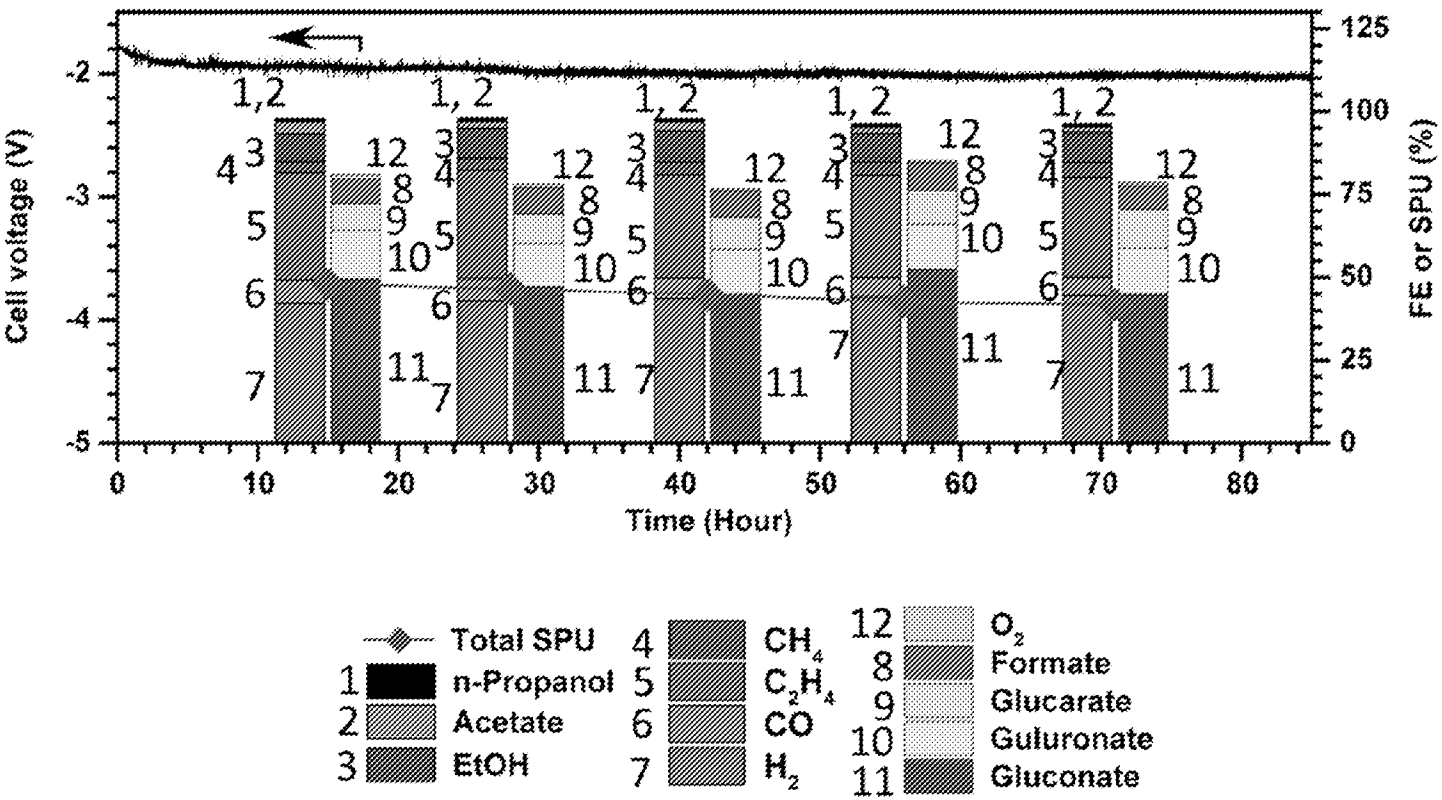
FIG. 35 illustrates the performance of the $CO_2$RR-GOR system under low $CO_2$ availability. The mass loadings on the cathode and anode electrodes are Cu: 0.5 mg $cm^{-2}$ and Pt: 2 mg $cm^{-2}$, including the long-term electrolysis performance with a $CO_2$ input flow rate of 0.36 sccm $cm^{-2}$. The experiments are performed at a current density of 100 mA $cm^{-2}$. The flow rate of the $CO_2$ supplied is normalized by the geometric area of the electrodes.

Similarly, stable GOR productivity was detected throughout (See FIG. 35 and table 9).

TABLE 9

The glucose oxidation reaction (GOR) product distribution of the Pt—C catalyst in the MEA during extended operation.

| Time | Faradaic efficiency (%) | | | | | $J_{gluconate}$ |
|---|---|---|---|---|---|---|
| (hour) | Gluconate | Formate | Glucarate | Glucuronate | Total | (mA $cm^{-2}$) |
| 15 | 49.7 | 7.6 | 8.1 | 14.4 | 79.8 | 49.7 |
| 28 | 47.3 | 8.2 | 8.9 | 12.8 | 77.2 | 47.3 |
| 42 | 45.0 | 8.1 | 9.5 | 13.5 | 76.1 | 45.0 |
| 56 | 52.5 | 8.4 | 10.3 | 13.4 | 84.6 | 52.5 |
| 71 | 45.0 | 7.2 | 11.6 | 13.8 | 77.6 | 45.0 |

MEA operating conditions: anolyte: 1M $KHCO_3$ + 1M glucose; anolyte flow rate: 20 mL/min; $CO_2$ inlet flow rate: 0.36 sccm $cm^{-2}$; cell temperature: 50° C.; and cell pressure: atmospheric pressure.

Notably, the present $CO_2$-to-$C_{2+}$ system demonstrates high stability while maintaining high carbon efficiency.

Figure 36:
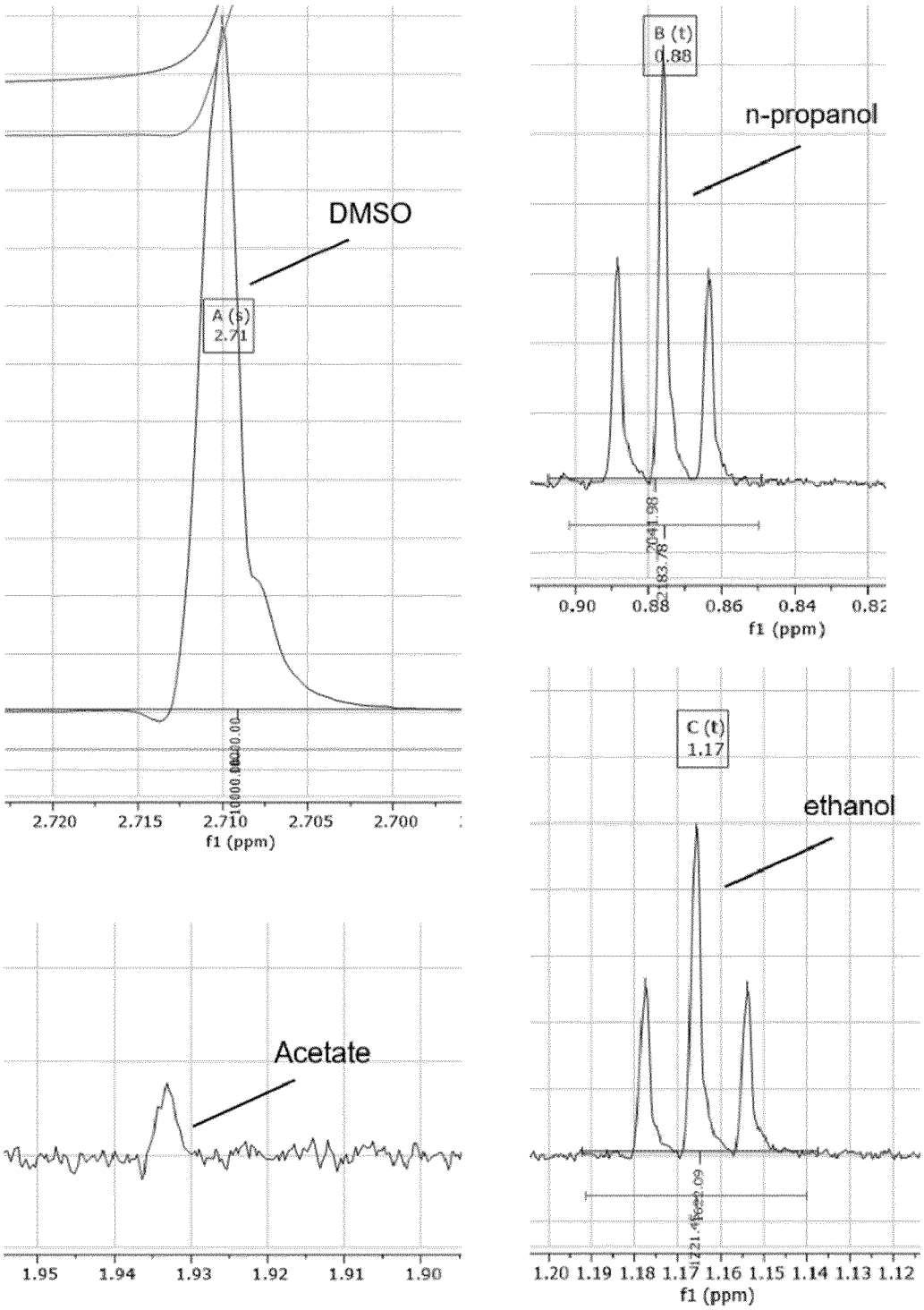
FIG. 36 shows peaks of a 1H NMR spectra corresponding to the liquid products of $CO_2$RR at the cathodic or anodic stream at 100 mA $cm^{-2}$.
Figure 37:
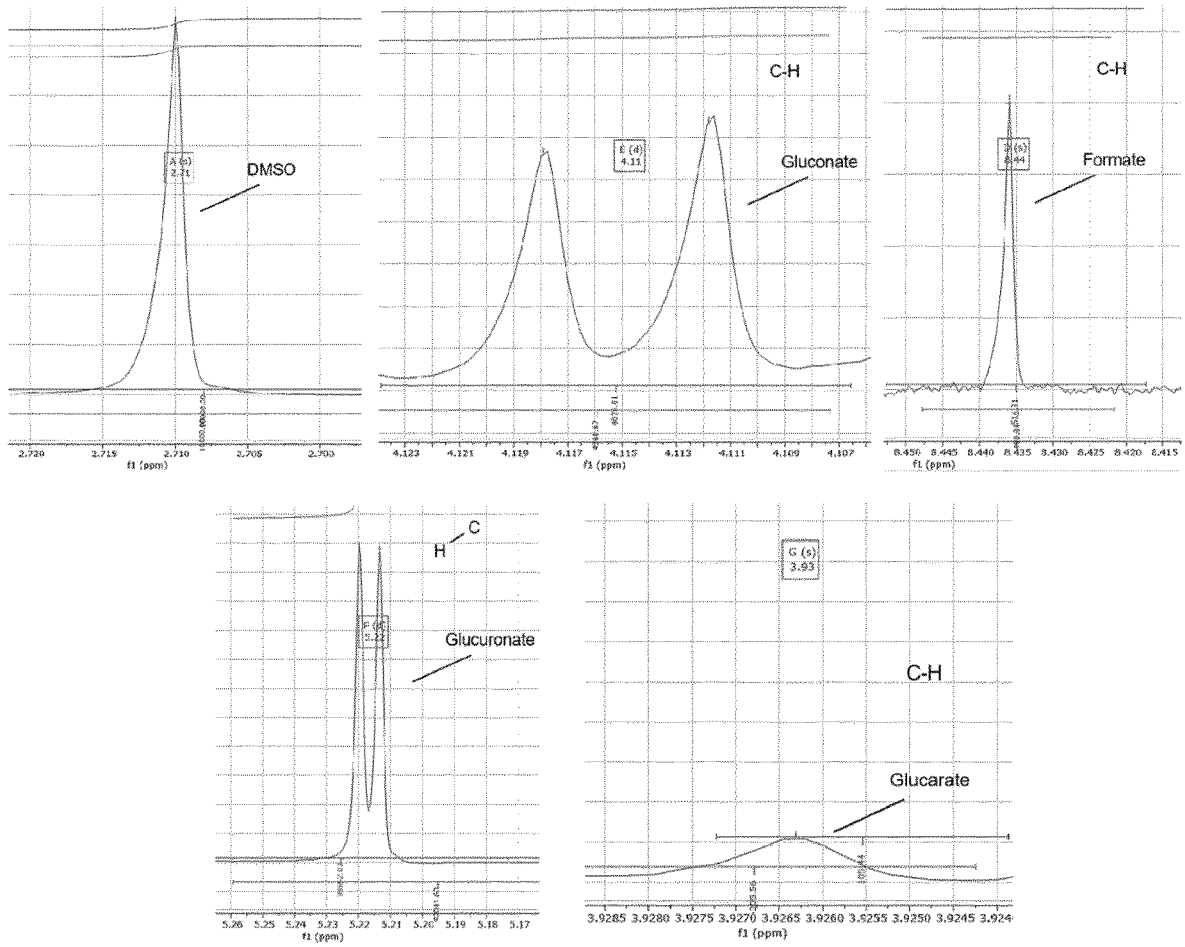
FIG. 37 shows peaks of a 1H NMR spectra corresponding to the glucose oxidation reaction (GOR) products in the anodic stream at 100 mA $cm^{-2}$.
Figure 38:
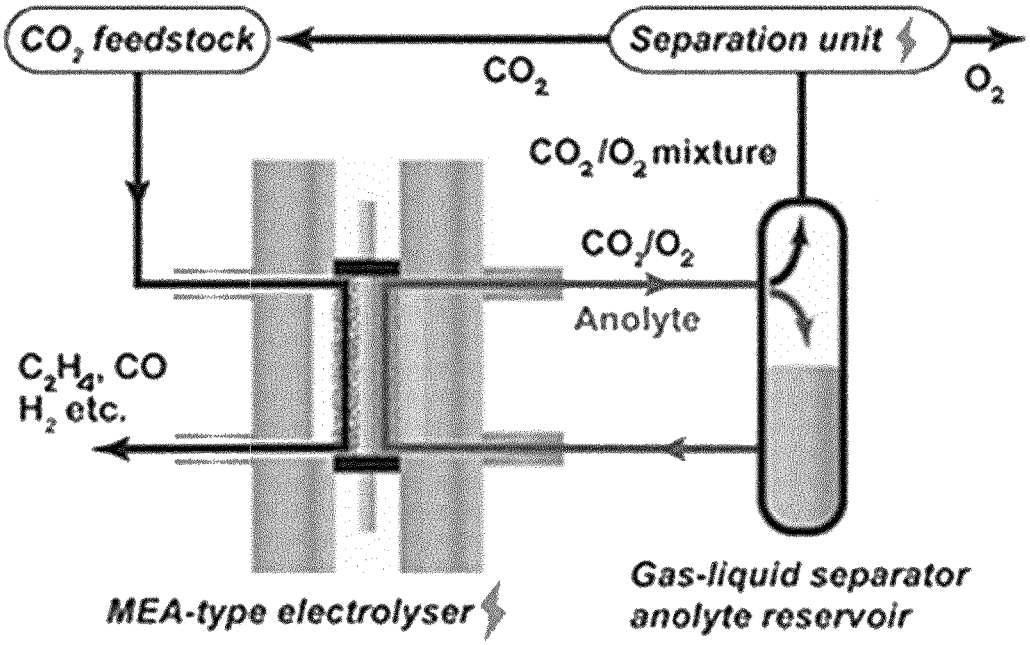
FIG. 38 illustrates the performance of an all-liquid anode enabling $CO_2$ recycling and low energy intensity for producing ethylene, including the operating principle of the conventional $CO_2$RR-OER electrolysis.
Figure 39:
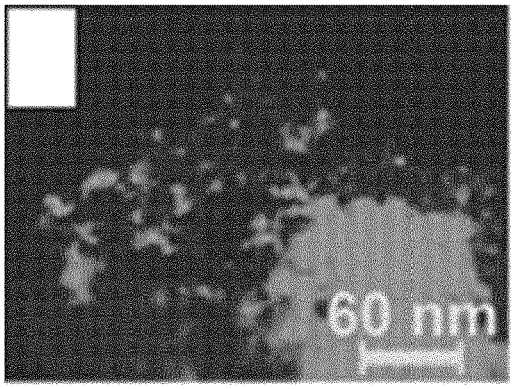
FIG. 39 illustrates an electron microscopy characterization of MEA electrolyser catalysts including the scanning transmission electron microscopy image for Pt/C catalyst.
Figure 40:
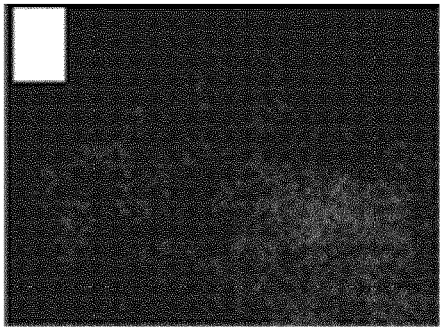
FIG. 40 illustrates an electron microscopy characterization of MEA electrolyser catalysts including the energy-dispersive X-ray spectroscopy (EDS) elemental mappings of platinum for Pt/C catalyst.
Figure 41:
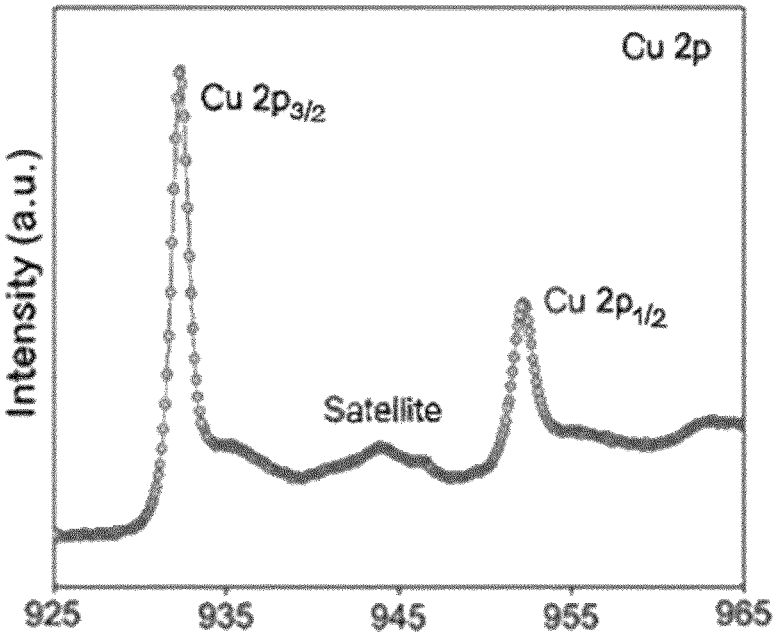
FIG. 41 shows X-ray photoelectron spectroscopy (XPS) measurements for copper nanoparticles (Cu NPs) on Cu/PTFE gas diffusion electrode.
Figure 42:
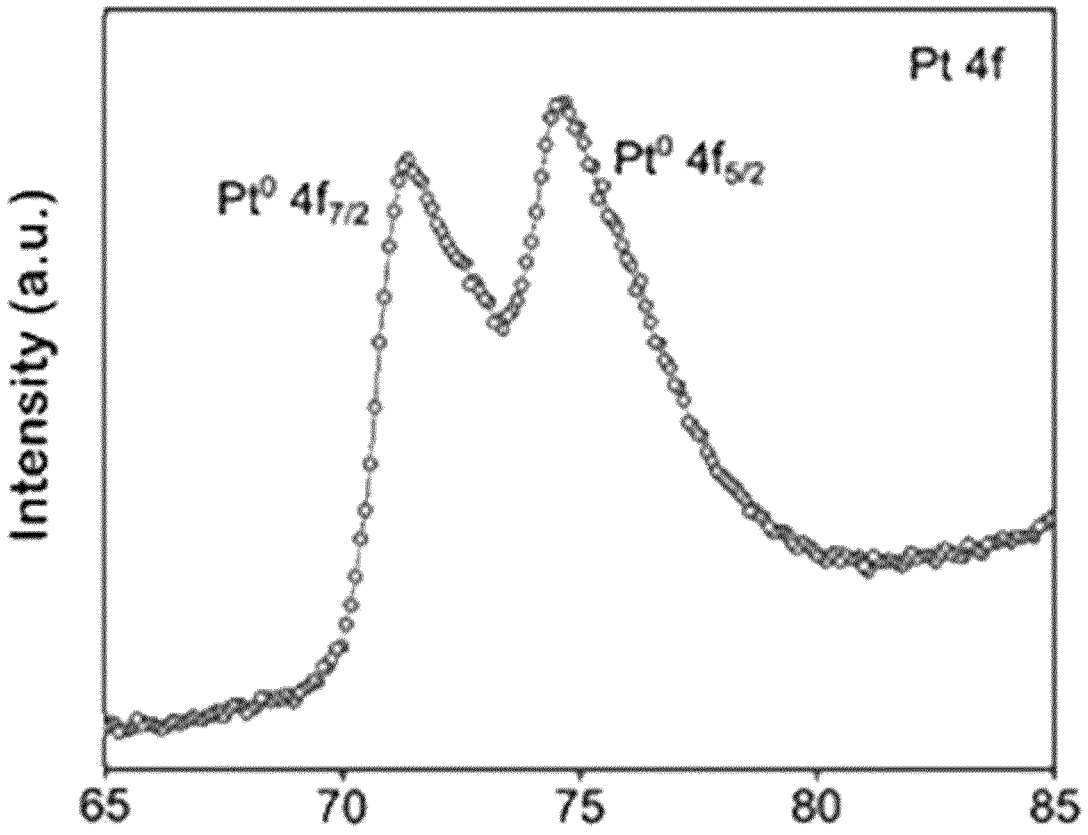
FIG. 42 shows X-ray photoelectron spectroscopy (XPS) measurements for a Pt—C on hydrophilic carbon cloth gas diffusion electrode.

The cathodic and anodic liquid-phase products were evaluated from the 1H NMR spectra of catholyte and anolyte, respectively. The typical 1H NMR spectra are shown in FIGS. 36 and 37. Notably, formate can be detected in the anolyte which is majorly ascribed to the oxidation of glucose. However, some of the formate may also come from the $CO_2$RR. In our previous studies, the Cu nanoparticle usually shows a low formate FE of <1.5%.

Energy Assessment

Energy consumptions for electrolyser electricity, cathodic separation, and anodic separation were evaluated for ethylene—the world's most produced feedstock. State-of-the-art $CO_2RR$ systems, including alkaline flow-cell electrolysers, neutral MEA electrolysers, acidic flow-cell and acidic MEA electrolysers were considered. This consideration is based on the performance metrics including selectivity, productivity, and full-cell voltage-combination of them in turn reflect as energy intensity of producing multi-carbon products (i.e. ethylene). The proximity of these performance metrics will help refine the effect of anodic and cathodic separation on the energy requirement for producing ethylene. Input parameters to the model for all the systems are summarized. The energy assessment model as well as the assumptions are based on a previous work. The majority of these input parameters listed in Table 1 are from the literature. The model considers a production rate of 1 ton/day, with the assumptions of $H_2$ and $O_2$ are the only products at the anodic and cathodic streams. The details of calculations for the carbon regeneration (for alkaline flow cell), cathodic separation (for all the electrolysers), and anodic separation (for neutral MEA electrolyser) can be found in the previous work. For acidic flow-cell and MEA electrolysers, no energy cost was assumed to be associated with the anodic separation considering no $CO_2$ availability at the anodic gas stream.

The invention claimed is:

1. A process for electrochemically converting a gaseous carbon dioxide stream to multi-carbon products having at least two carbon atoms in a carbon dioxide reduction reaction/organic oxidation reaction ($CO_2RR$/OOR), the process is characterized in that it comprises:

a) providing a $CO_2RR$/OOR system being a catholyte-free system and comprising:
   an anodic compartment comprising an anode and configured to operate the organic oxidation reaction; and
   a cathodic compartment comprising a cathode with a $CO_2$ reduction reaction catalyst being or comprising copper and being configured to operate carbon dioxide reduction reactions;

b) providing a solution comprising an anolyte and an organic liquid-phase precursor of an organic oxidation reaction;

c) supplying the solution to the anodic compartment of the $CO_2RR$/OOR system to operate the organic oxidation reaction and generate an anodic product mixture comprising OOR liquid-phase products;

d) supplying a gaseous $CO_2$-containing stream to the cathodic compartment of the $CO_2RR$/OOR system to operate the reduction of a first portion of $CO_2$ and generate a cathodic product mixture comprising multi-carbon products, wherein a second portion of $CO_2$ is transferred to the anodic compartment by an ionic exchange to produce a crossover $CO_2$;

e) recovering the anodic product mixture from the anodic compartment, the anodic product mixture comprising the crossover $CO_2$;

f) separating the crossover $CO_2$ from the anodic product mixture to produce a $CO_2$-depleted product stream and a recovered pure gaseous $CO_2$ stream.

2. The process according to claim 1 is characterized in that the $CO_2$ concentration of the gaseous $CO_2$-containing stream is ranging between 5 vol. % and 95 vol. %, based on the total volume of the gaseous $CO_2$-containing stream; or between 10 vol. % and 90 vol. %.

3. The process according to claim 1 is characterized in that the process is carried out at a temperature ranging between 30° C. and 50° C.

4. The process according to claim 1 is characterized in that the gaseous $CO_2$-containing stream is a by-product $CO_2$ stream produced from an industrial upstream process.

5. The process according to claim 4 is characterized in that the industrial upstream process is fermentation of glucose to ethanol.

6. The process according to claim 1 is characterized in that the OOR liquid-phase products comprise gluconate, glucuronate, glucarate, formate, tartarate, tratronate or any mixture thereof.

7. The process according to claim 1 is characterized in that it further comprises redirecting the recovered pure gaseous $CO_2$ stream to the cathodic compartment as a portion of the gaseous $CO_2$-containing stream to maximize $CO_2$ utilization.

8. The process according to claim 1 is characterized in that it comprises redirecting the recovered pure gaseous $CO_2$ stream as a feedstream to another electrolyser being a solid oxide electrolyser cell, a membrane electrode assembly electrolyser, an alkaline flow cell or any combination thereof.

9. The process according to claim 1 is characterized in that the anolyte is selected from $KHCO_3$, $K_2CO_3$, $NaHCO_3$, $Na_2CO_3$ and any mixture thereof.

10. The process according to claim 1 is characterized in that the organic liquid-phase precursor is or comprises one or more selected from glucose, glycerol, furfural, 5-hydroxymethylfurfural, ethanol, n-propanol, iso-propanol, methanol, benzyl alcohol, starch, cellulose, lignin and any mixtures thereof.

11. The process according to claim 1 is characterized in that the solution comprising the anolyte and the organic liquid-phase precursor has a bulk pH between 4 and 9.

12. The process according to claim 1 is characterized in that the multi-carbon products are or comprise ethylene.

* * * * *